US012702888B2

(12) United States Patent
Sims, III

(10) Patent No.: US 12,702,888 B2
(45) Date of Patent: Aug. 11, 2026

(54) ISOMETRIC, DYNAMIC ISOTONIC CONCENTRIC AND DYNAMIC ISOTONIC ECCENTRIC MOTORIZED GUIDANCE EXERCISE APPARATUS

(71) Applicant: Dewey M Sims, III, Berkely, MI (US)

(72) Inventor: Dewey M Sims, III, Berkely, MI (US)

( * ) Notice: Subject to any disclaimer, the term of this patent is extended or adjusted under 35 U.S.C. 154(b) by 151 days.

(21) Appl. No.: 18/481,555

(22) Filed: Oct. 5, 2023

(65) Prior Publication Data

US 2025/0114654 A1 Apr. 10, 2025

(51) Int. Cl.
*A63B 21/002* (2006.01)
*A63B 21/00* (2006.01)
(Continued)

(52) U.S. Cl.
CPC .... *A63B 21/0023* (2013.01); *A63B 21/00181* (2013.01); *A63B 21/0058* (2013.01);
(Continued)

(58) Field of Classification Search
CPC ..... A63B 21/0023; A63B 21/00181; A63B 21/0058; A63B 21/062; A63B 21/065; A63B 21/4033; A63B 24/0062; A63B 2024/0093; A63B 2071/0655; A63B 2220/51; A63B 2220/833; A63B 2022/0038; A63B 2022/0041; A63B 21/0628; A63B 21/4047; A63B 22/205; A63B 23/03541; A63B 23/02; A63B 23/0205; A63B 23/0211; A63B 23/0233; A63B 21/00061; A63B 21/00065; A63B 21/00069; A63B 21/00072;
(Continued)

(56) References Cited

U.S. PATENT DOCUMENTS 2,784,591 A 3/1957 Shoor
6,551,219 B1 4/2003 Brown
(Continued)

FOREIGN PATENT DOCUMENTS

CN 107019895 A * 8/2017 ..... A63B 22/04

OTHER PUBLICATIONS

Sears, Brett; Using the Upper Body Ergometer in Physical Therapy; May 12, 2022; Very Well Health; www.verywellhealth.com.

*Primary Examiner* — Loan B Jimenez
*Assistant Examiner* — Jacqueline N L Loberiza
(74) *Attorney, Agent, or Firm* — Mastrogiacomo PLLC; Patrick Mastrogiacomo, Jr.

(57) ABSTRACT

A motorized guidance exercise apparatus for human muscle development is provided. The apparatus comprises an electric motor, a drive guidance assembly secured to the apparatus and to the motor, a headboard secured to the guidance assembly, an assistance and resistance force device secured to a limb or a torso of the human body, the limb or the torso positioned proximate the headboard, at least one force sensor to determine the effort expended by the human muscle to move the assistance and resistance force device, and wherein energizing the motor actuates the guidance assembly to induce a motion in the headboard, wherein the headboard is engaged by the limb or the torso and the assistance and resistance force device is moved by the limb or the torso, thereby guiding the limb and the muscle through an exercise movement with tactile feedback.

4 Claims, 32 Drawing Sheets

(51) Int. Cl.

| | |
|---|---|
| ***A63B 21/005*** | (2006.01) |
| ***A63B 21/062*** | (2006.01) |
| ***A63B 21/065*** | (2006.01) |
| ***A63B 24/00*** | (2006.01) |
| ***A63B 71/06*** | (2006.01) |

(52) U.S. Cl.
CPC ..... *A63B 21/062* (2013.01); *A63B 21/065* (2013.01); *A63B 21/4033* (2015.10); *A63B 24/0062* (2013.01); *A63B 2024/0093* (2013.01); *A63B 2071/0655* (2013.01); *A63B 2220/51* (2013.01); *A63B 2220/833* (2013.01)

(58) Field of Classification Search
CPC ..... A63B 21/00178; A63B 21/00192; A63B 21/005; A63B 21/0051; A63B 21/0052; A63B 21/0053; A63B 21/0057; A63B 21/008; A63B 21/0083; A63B 21/012; A63B 21/0125; A63B 21/015; A63B 21/018; A63B 21/0601; A63B 21/06; A63B 21/0602; A63B 21/0603; A63B 21/0604; A63B 21/0605; A63B 21/0606; A63B 21/0607; A63B 21/0608; A63B 21/0609; A63B 21/0615; A63B 21/0616; A63B 21/0617; A63B 21/0618; A63B 21/0783; A63B 21/08; A63B 21/15; A63B 21/151; A63B 21/152; A63B 21/153; A63B 21/154; A63B 21/155; A63B 21/156; A63B 21/157; A63B 21/158; A63B 21/159; A61H 1/02; A61H 1/0292; A61H 1/0244; A61H 1/0218; A61H 2001/0207; A61H 1/0222; A61H 1/0229; A61H 2001/0233
See application file for complete search history.

(56) References Cited

U.S. PATENT DOCUMENTS

| | | | | |
|---|---|---|---|---|
| 10,814,172 | B1 | 10/2020 | Ilfrey et al. | |
| 11,103,411 | B2 | 8/2021 | Saglia et al. | |
| 11,161,002 | B2 | 11/2021 | Radcliffe et al. | |
| 11,175,590 | B2 | 11/2021 | Nicholas | |
| 11,406,867 | B1 | 8/2022 | Beck et al. | |
| 11,433,276 | B2 | 9/2022 | Bissonnette et al. | |
| 2008/0248926 | A1* | 10/2008 | Cole | A63B 24/00 482/5 |
| 2014/0092741 | A1 | 4/2014 | Diallo | |
| 2018/0326241 | A1 | 11/2018 | Huskins et al. | |
| 2020/0188719 | A1 | 6/2020 | Brand et al. | |
| 2021/0260445 | A1 | 8/2021 | Knestel et al. | |
| 2021/0339067 | A1* | 11/2021 | Sims, Jr. | A63B 21/4049 |
| 2023/0115159 | A1* | 4/2023 | Weller | A63B 24/0006 482/72 |

* cited by examiner

ISOMETRIC, DYNAMIC ISOTONIC CONCENTRIC AND DYNAMIC ISOTONIC ECCENTRIC MOTORIZED GUIDANCE EXERCISE APPARATUS

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to an exercise apparatus and, more particularly, to an exercise apparatus that incorporates a motorized guidance mechanism to guide a human body part, such as a limb or trunk, using tactile feedback, through a predetermined path under a constant load and speed to lengthen and shorten the muscles of the human body thereby improving fitness workouts and speeding recovery and rehabilitation.

2. Background Art

There are many exercise apparatuses that are used to strengthen and tone muscles of the lower body and upper body extremities. Many individuals use these apparatuses to train muscles for a particular sporting event and to improve overall fitness. Still others use these machines to rehabilitate muscles that have grown weak and lost range of motion due to injury, lack of use or old age.

Cyclic ergometers are one such piece of exercise equipment that is used for high intensity sports training, developing overall fitness and rehabilitation of weak muscles. Typically, cyclic ergometers are operated solely under the power of the individual. Individuals rely on their own muscle strength and development to operate the cyclic ergometer. Further gains in muscle strength and development are realized when the individual is able to exercise the muscles past a point of fatigue. While there are those experienced with exercising muscles to fatigue to improve strength and stamina, there are many that cannot exercise their muscles to that point because their muscles may be too weak. Others may not know when their muscles are at a point of fatigue during an exercise session. In either case, individuals are likely not able to optimize their workout or rehabilitation session and, therefore, may delay desired results or slow recovery from injury or surgery. Furthermore, when individuals perform a specific exercise, they are only exercising their muscles in only one way. A typical exercise will either exercise muscles only as they lengthen or muscles only as they shorten. Typical exercises, such as cycling, walking, swimming and the like will not exercise muscles as they are both lengthening and shortening.

Various weight machines are other types of exercise equipment that may be used to develop muscles. These machines typically are equipped with adjustable weight plates that allow the user to choose a specific weight to lift. The weight machines may come in a variety of configurations to work the muscles of the chest, back, arms, legs and the like. Just as above with cyclic ergometers, individuals rely on their own muscle strength and endurance to use muscle groups to move the weights. Often individuals will jerk the weights when first beginning an exercise, the exertion phase, to overcome the initial weight and any friction in the exercise equipment. This added jerk or acceleration of the weight plates during the initial stages of the exercise to move the weight may not be expected by the individual and may lead to injuries in muscles, ligaments, tendons and bones. Similarly, individuals may allow the weights to fall rapidly during the lowing phase of the weights and stop suddenly when the weights reach the end of downward travel. This rapid deceleration force may also lead to injuries in muscles, ligaments, tendons and bones. Further, the individual often will not move the weights at a consistent speed or at a constant range of motion resulting in an inconsistent workout that may not yield the desired results and may lead to injuries in muscles, ligaments, tendons and bones.

As the global population ages, there is becoming an ever-increasing need for exercise equipment that will provide individuals the best results in the least amount of time and lower chances of injury. There is also a need for exercise equipment that is easy to operate and offers motorized guidance to individuals with muscles too weak to operate the exercise equipment. There is a further need for exercise equipment that is easy to operate and offers motorized guidance for those individuals that desire to speed muscle development and improve overall health while in a controlled manner, yet are unable to do so with traditional muscle development means such as weight lifting.

Therefore, a need exists for a motorized guidance exercise apparatus capable of enabling isometric, dynamic isotonic concentric and dynamic isotonic eccentric movement of muscles and joints within an individual by forcing the muscles and joints through an exercise movement to enable prolonged engagement in a particular exercise. The motor will continue to operate the equipment in a very controlled manner and enable the individual to maintain the exercise movement under a controlled consistent speed and motion to minimize accelerations and decelerations. Also, the motorized guidance exercise apparatus will exercise muscles of an individual as the muscles are both lengthening and as the muscles are shortening. Prior to each exercise, the apparatus allows individuals to vary speed, range of motion and amount of weight for core body exercises. Further, the motorized guidance exercise apparatus will provide a level of assistance to an individual rehabilitating an injury, beginning an exercise regimen or working to improve their overall health and enable the individual to review their level of effort during the exercise. Still further, the motorized guidance exercise apparatus may be capable of stopping the motion at any location for a period of time to produce isometric exercise as part of the dynamic isotonic concentric and dynamic isotonic eccentric exercise. This prolonged constant engagement in an exercise will push the muscles engaged in the exercise to the point of muscle fatigue and facilitate faster muscle development, a shorter muscle rehabilitation and overall recovery period while minimizing injury.

BRIEF SUMMARY OF THE INVENTION

An isometric, dynamic isotonic concentric and dynamic isotonic eccentric motorized guidance exercise apparatus for human muscle development is provided. The exercise apparatus comprises at least one electric motor, the at least one electric motor including an output shaft, a drive guidance assembly, the drive guidance assembly secured to the exercise apparatus and connected to the at least one electric motor, the drive guidance assembly includes a bar, the bar secured between said at least one electric motor and a handle of a weight bench, at least one tactile feedback interface member, the at least one tactile feedback interface member is a headboard of said weight bench and the headboard is secured to the drive guidance assembly a the handle, an assistance and resistance force device, the assistance and resistance force device configured to be secured to a limb or a torso of the human body, the limb or the torso positioned proximate the headboard, at least one force sensor, the at least one force sensor calibrated to determine the effort expended by the human muscle to move the assistance and resistance force device, and wherein energizing the at least one electric motor actuates the drive guidance assembly, the at least one electric motor induces a linear motion in the bar and the handle to raise and lower the headboard relative to the weight bench, wherein the headboard is configured to be engaged by the limb or the torso and the assistance and resistance force device is configured to be actuated by the limb or the torso, thereby guiding the limb and the muscle through an exercise movement with tactile feedback.

BRIEF DESCRIPTION OF THE SEVERAL VIEWS OF THE DRAWINGS

The features and inventive aspects of the present invention will become more apparent from the following detailed description, claims, and drawings, of which the following is a brief description:

FIGS. 2M-20 are front views of the force gauge of the pedal of the motorized guidance exercise apparatus depicted in FIGS. 2A-2D;

FIG. 31 is a side view of a force sensor of the foothold of the of the motorized guidance exercise apparatus depicted in FIGS. 3A-3H;

FIG. 5 is a computer monitor with sample message for use with a motorized guidance exercise apparatus according to an embodiment of the present invention.

DETAILED DESCRIPTION OF THE INVENTION

Figure 1A:
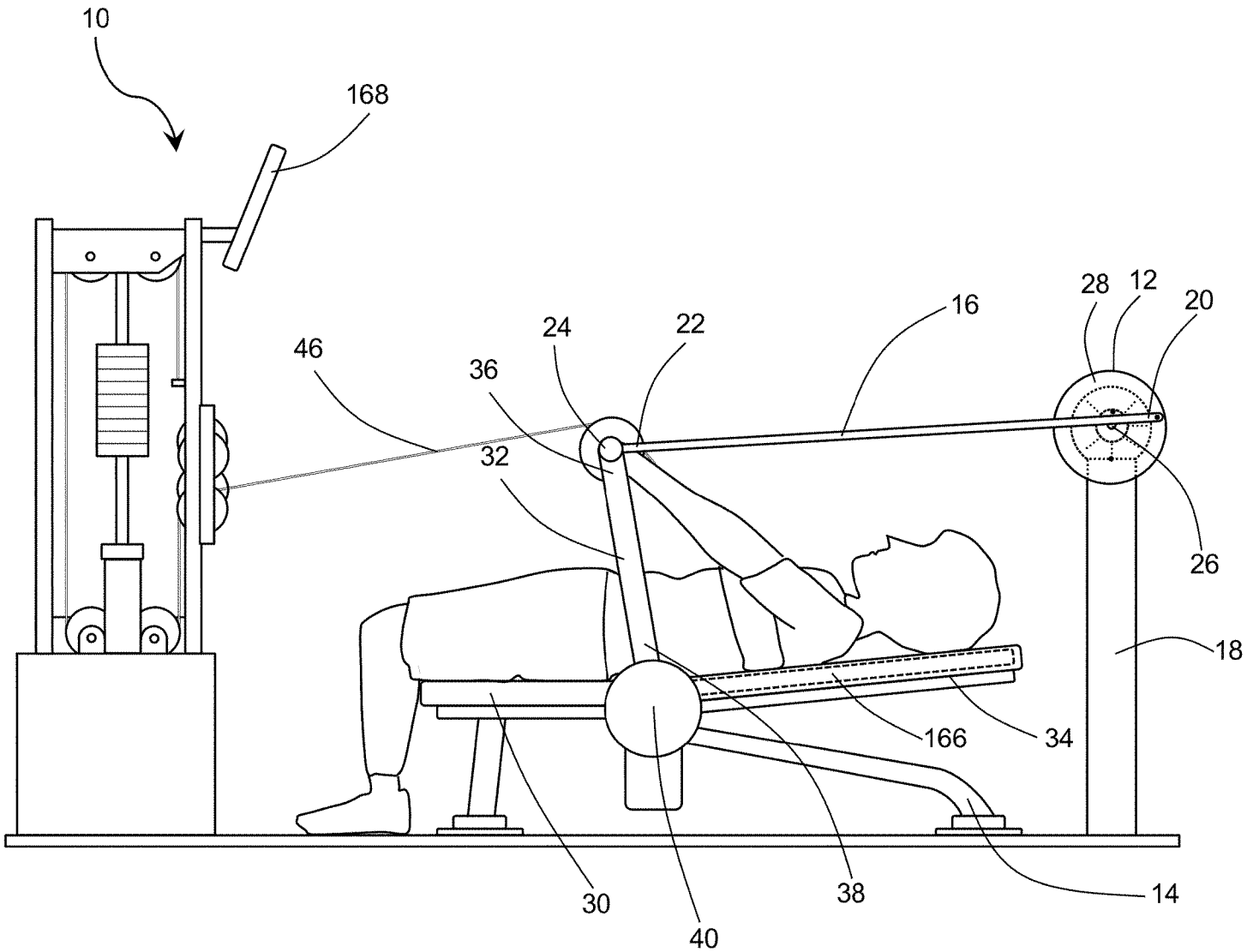
FIGS. 1A-1B are side views of a motorized guidance exercise apparatus according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

An isometric, dynamic isotonic concentric and dynamic isotonic eccentric motorized guidance exercise apparatus 10 is presented below and illustrated in FIGS. 1A-41. Exercise apparatus 10 may be used as an assistance means to effectively rehabilitate or exercise muscles of the human body that are, due to their physical limitation, not able to operate a standard exercise apparatus under human muscle power alone. Apparatus 10 may also be used by individuals who desire to speed muscle development and improve overall health and fitness. Furthermore, apparatus 10 allows individuals with a limb that may have a disability (for example, one limb may not have a full range of motion and/or be weaker than the other limb) to use apparatus 10 when exercising both limbs by allowing the disabled limb to use lighter weight or a different stroke or range of motion (see FIGS. 2A-4G). Still further, apparatus 10 will enable individuals to exercise various muscles of the human body through isometric exercises when the motorized guidance is stopped for a period of time at one or more predetermined locations. Even further, the motorized guidance exercise apparatus will provide a level of assistance to an individual rehabilitating an injury, beginning an exercise regimen or working to improve their overall health and enable the individual to review their level of effort during the exercise.

Figure 1B:
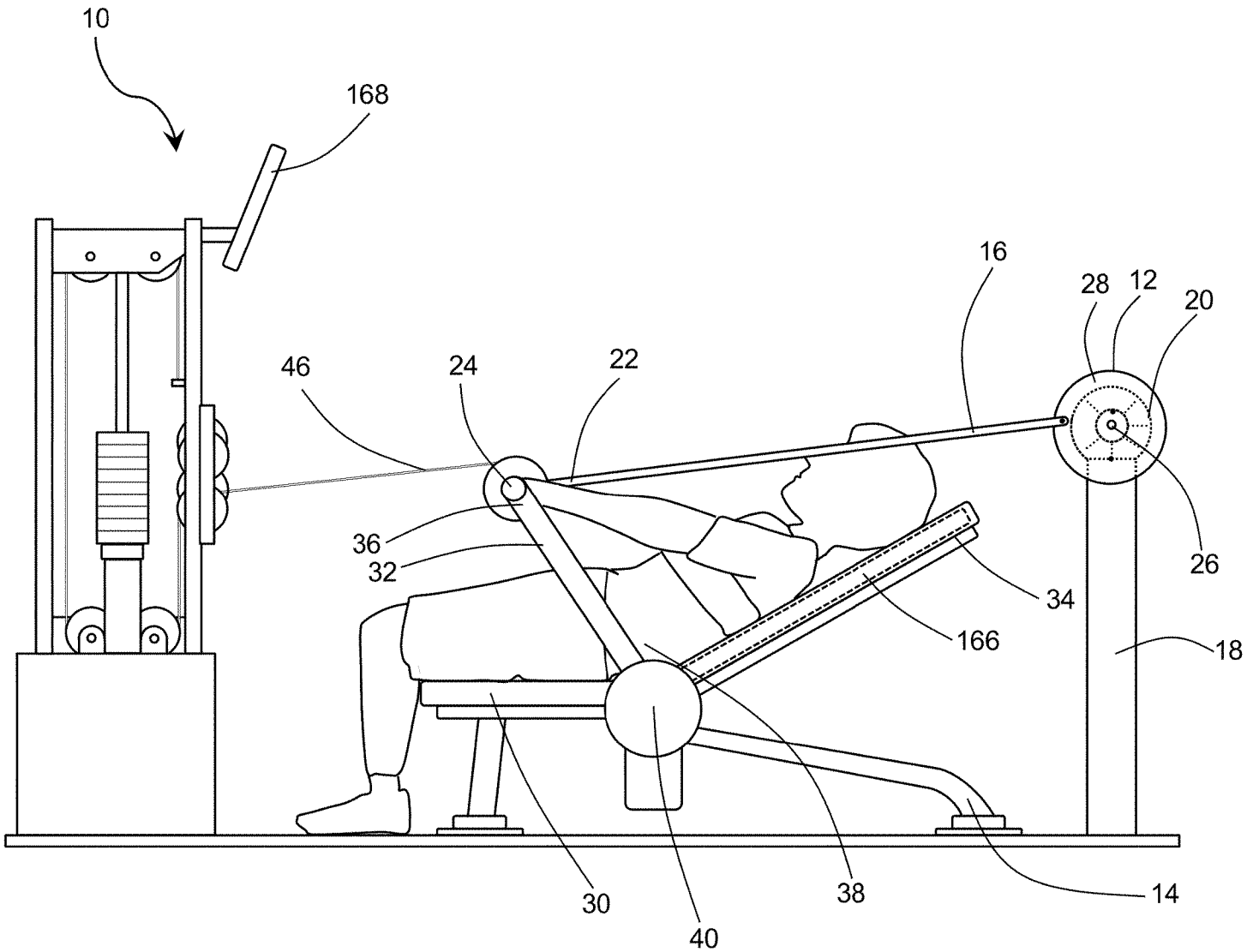
Figure 1C:
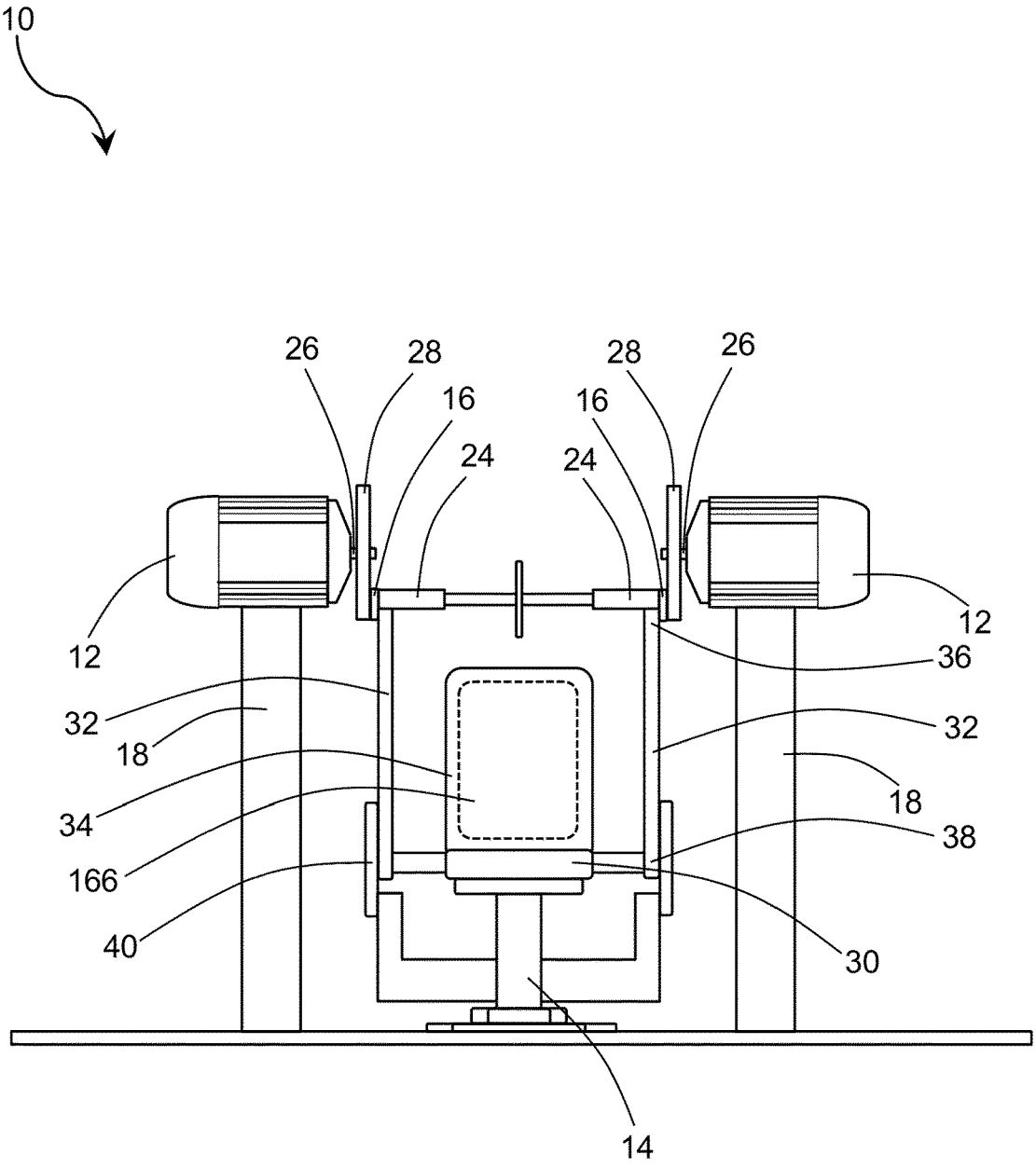
FIG. 1C is a front view of the motorized guidance exercise apparatus depicted in FIGS. 1A-1B.

According to an embodiment of the present invention, an electric motor 12 may be added to a weight bench 14 with a drive guidance assembly 16 to enable motorized guidance exercise apparatus 10 illustrated in FIGS. 1A-1C. Motor 12 may be supported by a stanchion 18. Motor 12 may be any type of motor including but not limited to a typical induction motor, a direct drive motor, a linear motor, a servo motor, a stepper motor and the like that may be connected to a power supply such that when motor 12 is energized, a shaft 26 of motor 12 is rotated within motor 12. Shaft 26 may be connected to flywheel 28 such that the rotating force of shaft 26 induces a rotating motion in flywheel 28. In this particular embodiment of the present invention, drive guidance assembly 16 may be a bar having a first end 20 that may be secured to motor 12 at flywheel 28 and a second end 22 that may be secured to a handle 24 of weight bench 14.

Weight bench 14 may include a seat 30, at least one arm 32, and a headboard 34. Seat 30 supports the lower portion of a human body as the individual lies prone on weight bench 14. Headboard 34 may be intended to provided only light support of the head, the back, and the torso of the human body as the individual lies prone on weight bench 14. Arm 32 is connected to handle 24 at a first end 36 and arm 32 is connected to headboard 34 at a second end 38 of weight bench 14. In this particular embodiment of the present invention, two arms 32 may be connected to headboard 34 (see FIG. 1C). The individual may engage handles 24 with their hands. Further, headboard 34 and arms 32 are configured to rotate relative to backboard 30 at a pivot point 40 such that the head, back, and torso may be raised and lowered relative to the lower portion of the body (see FIGS. 1A and 1B) to shorten and lengthen the muscles of the abdomen.

In this particular embodiment of the present invention, a typical weight stack 50 including a plurality of weight plates 44 may be added to exercise apparatus 10 to provide assistance and resistance for the abdomen muscles of the individual to raise and lower headboard 34 of weight bench 14. Weights plates 44 may provide assistance to the abdomen muscles as the torso and head of the individual are raised as headboard 34 is raised. Weights plates 44 may provide resistance to the abdomen muscles as the torso and head of the individual are lowered as headboard 34 is lowered. A cable 46 may be used to connect a harness 42, harness 42 being secured at the torso of an individual during exercise (see FIGS. 1A and 1B), to weight plates 44. A pulley 48 may be added to handles 24 of weight bench 14 to guide cable 46 from harness 42 to plates 44 as illustrated in FIGS. 1A and 1B. Pulley 48 enables cable 46 to glide smoothly as the torso and head are raised and lowered as headboard 34 is raised and lowered. An adjustable pulley 48 may also be included in apparatus 10 to allow pulley 48 and cable 46 to be easily adjusted by the individual to modify the exercise range of motion for optimal muscle development. Pulley 48 also translates the rotational motion of the torso and the head to a lateral motion of weight plates 44. The amount of assistance and resistance may be adjusted by increasing or decreasing the number of weight plates 44 in the stack. It is important to note that weight stack 50 may be substituted with a barbell, dumbbells, springs, bands and the like and still provide assistance and resistance for the individual using weight bench 14.

With individual positioned on weight bench 14, apparatus 10 may be operated in the following manner. Electric motor 12 may be actuated to rotate flywheel 28 and induce a linear motion in bar 16 to raise and lower headboard 34 relative to seat 30. As headboard 34 raises and lowers, the individual may sustain only a light force against the surface of headboard 34 and allow the tactile touch of the torso and head against headboard 34 and hands with handles 24 to provide information to the individual when to raise and when to lower their head and torso. Weight plates 44, attached to the torso at harness 42, provide assistance to those who may be injured or have weak abdomen muscles by aiding the raising and lowering motions of the individual. Cable 46 is always in tension and applying a load to the torso through harness 42 as the torso and head raise and lower with headboard 34. As motor 12 rotates to raise headboard 34 and the torso and head of the individual, the muscles of the abdomen are contracted or shorten to enable the individual to sit up as weight plates 44 pull at harness 42 and plates 44 are lowered on weight stack 50. As motor 12 continues to rotate to lower headboard 34 and the torso and head of the individual, the muscles of the abdomen are stretched or lengthened against the resistance of weight plates 44 as harness 42 pull at weight plates 44 and plates 44 are raised on weight stack 50. It is this shortening and lengthening of the abdomen muscles during the exercise that enable the muscles to repair and strengthen enabling the individual to heal and improve their overall health.

An individual may need to exert more effort in terms of energy by the human body to maintain light contact with headboard 34 as the load from weight plates 44 is increased. The increase in effort exerted by the individual to ensure the head and torso maintain tactile contact with headboard 34 while the torso is secured to weight plates 44 by harness 42 and cable 46, results in increased use of the subject muscles in the abdomen leading to fatigue of the muscles which results in overall development of the muscles.

Figure 1D:
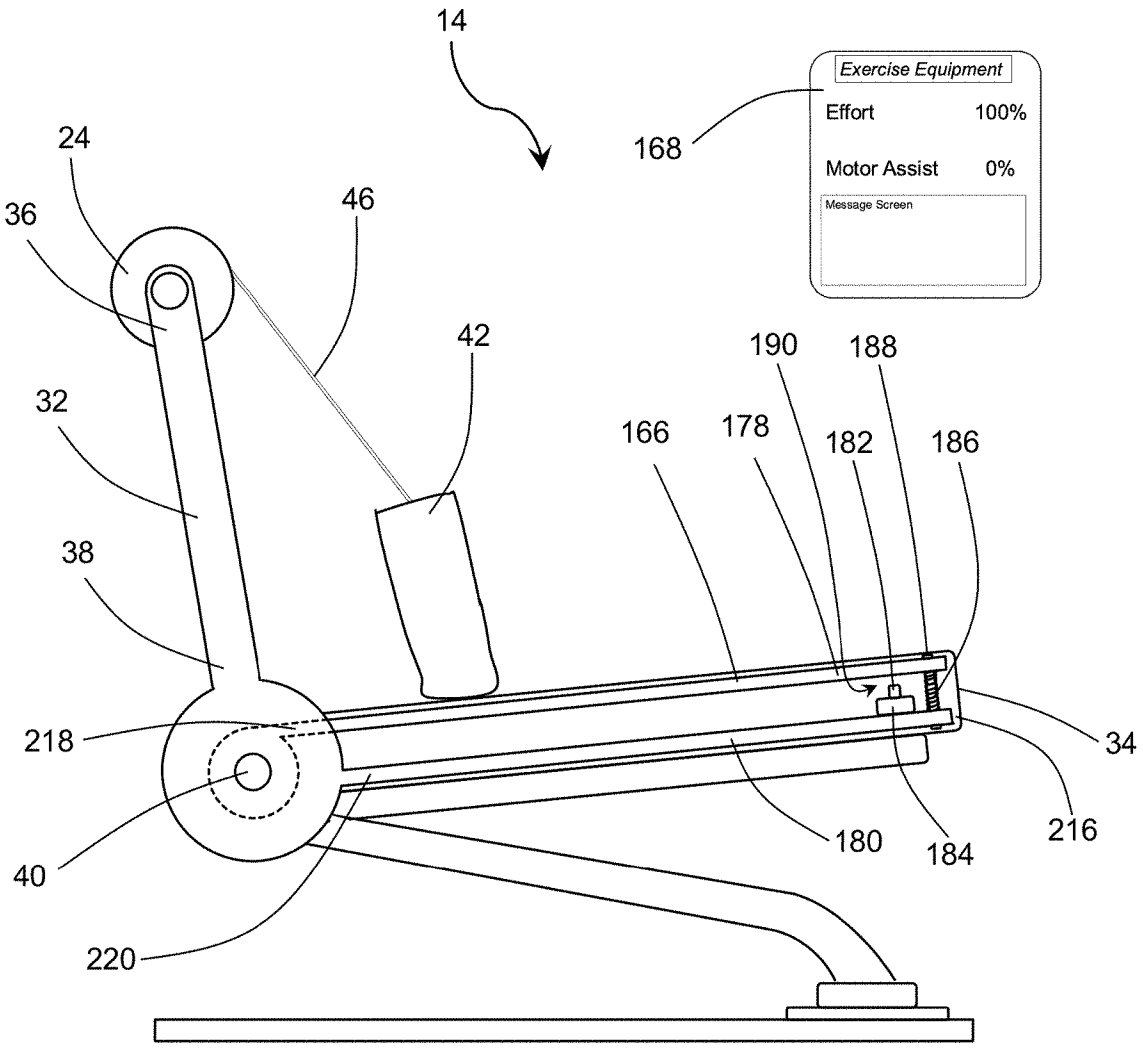
FIGS. 1D-1E are side views of a force sensor of the motorized guidance exercise apparatus according to an embodiment of the present invention.
Figure 1E:
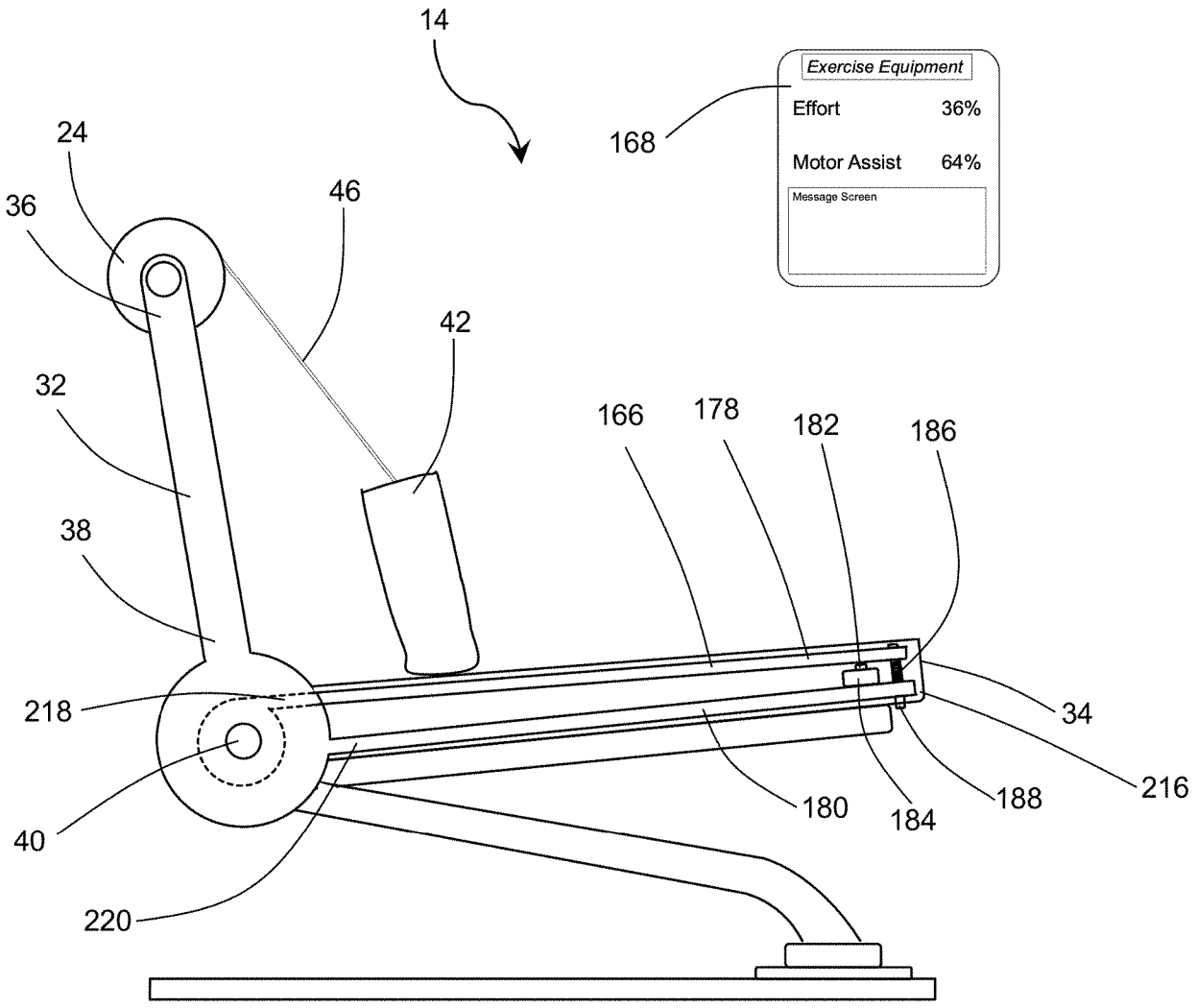

Referring now to FIGS. 1D and 1E, a force sensor 166 and force gauge 184 may be included in headboard 34 to indicate to the individual, through a computer monitor 168, the amount of force the individual is applying to headboard 34 during the exercise motion. As stated above, the individual may need to exert more effort in terms of energy by the human body to maintain a light tactile contact with headboard 34 as headboard 34 is being raised by motor 12 and drive guidance assembly 16 and weight plates 44 are lowered on weight stack 50. In this instance, the force against force sensor 166 may be low and the human "Effort" reading on monitor 168 (see FIG. 5) may be high, for example close to 100% and the "Motor Assist" reading may be low, for example close to 0%. This would indicate to the individual that they are using their muscles at near maximum effort during the exercise to follow the motion of headboard 34, rather than relying on support from headboard 34 and motor 12, resulting in near optimal development of the subject muscles in the abdomen. Conversely, the individual may rely on headboard 34 and motor 12 for assistance to raise their upper torso as headboard 34 is raised. In this instance, the force against force sensor 166 may be high and the human "Effort" reading on monitor 168 may be low, for example close to 50% and the "Motor Assist" reading may be high, for example close to 50%. This would indicate to the individual that they are using their muscles at near minimal effort during the exercise as the weight of their torso is supported by the headboard 34 rather than using tactile feedback to follow the motion of headboard 34. The force may also be measured with force gauge 184 as headboard 34 is lowered relative to seat 30 to determine the effort level of the individual as headboard 34 is lowered. The effort information provided on monitor 168 may be used by the individual user of exercise apparatus 10, prescribing physical therapist, trainer, prescribing physician and others to guide development of the abdomen muscles to speed rehabilitation and improve overall health of the individual.

Force sensor 166 may include a force plate 178 and a support plate 180 within headboard 34. A guide rod 188 is inserted into a compression spring 186 and are both are connected to force plate 178 and support plate 180 at a first end 216 of force gauge 184. A second end 218 of force plate 178 is secured to bench 14 and at pivot point 40. Second end 218 of force plate 178 may rotate about pivot point 40 relative to support plate 180. A second end 220 of support plate 180 may be fixedly secured to bench 14 at second end 38 of arm 32 near pivot point 40. A force gauge plunger 182 and force gauge 184 are positioned at first end 216 of headboard 34 and secured to support plate 180. The tension in compression spring 186 maintains a gap 190 between force plate 178 and force gauge plunger 182. Gap 190 enables the individual to experience the tactile feedback from headboard 34. As detailed above, the individual will expend effort in the form of abdominal muscle fatigue to maintain gap 190 and not activate plunger 182 and force gauge 184, thereby maximizing their effort expended as indicated on monitor 168. If the individual fatigues and cannot maintain gap 190, force plate 178 will contact and engage plunger 182. Headboard 34 of bench 14 and motor 12 will begin to increase the amount of work expended to raise and lower the torso of the individual and the individual will expend less energy. As the individual fatigues further, plunger 182 descends deeper into force gauge 184 resulting in even less energy expended by the individual and more work done by motor 12. As force plate 178 contacts plunger 182, force measurements are taken and results displayed on monitor 168. Once again, the effort information provided on monitor 168 may be used by the individual user of exercise apparatus 10, prescribing physical therapist, trainer, prescribing physician and others to guide development of the abdomen muscles to speed rehabilitation and improve overall health of the individual.

In a typical exercise apparatus utilizing weight plates, the amount of resistance may be adjusted by selecting the number of weight plates the individual desires to move. Generally, an increase in the number of weight plates secured to the weight stack will increase the weight and overall resistance the individual must overcome to move the weight stack. The same concept may be used in this particular embodiment of the present invention. The prescribing physical therapist or individual user of exercise apparatus 10 may determine how much assistance and resistance to be increased at the torso while raising and lowering headboard 34 by selecting the number of weight plates 44 lowered and raised on stack 50. Allowing for an adjustment in the weight to be moved, will provide for a broader range of exercise capability. Furthermore, the speed of motor 12 may be adjustable thereby enabling one to adjust the frequency at which headboard 34 is raised and lowered and how quickly the abdomen muscles are contracted and expanded. Still further, the length of drive guidance assembly 16 may be adjusted, by lengthening or shortening drive guidance assembly 16, to modify the range of motion of headboard 34 relative to the remainder of bench 14 to further enhance the exercise experience. Modifying the range of motion of apparatus 10 will also help to increase and improve the flexibility of the individual. Further, apparatus 10 will enable individuals to exercise abdomen muscles through isometric exercises when motor 12 is stopped for a period of time to hold headboard 34 at one or more predetermined locations.

In another embodiment of the present invention depicted in FIGS. 2A, 2B and 2E-2I, electric motor 12 may be added to a ski simulator 52 along with a drive guidance assembly 54 to enable motorized guidance exercise apparatus 100. Drive guidance assembly 54 may include a rotary gear 56 secured to motor 12 at shaft 26 (see FIG. 2F). A rod 58 may also be included in drive guidance assembly 54 and a first spiral threaded section 60 of rod 58 is provided to engage the teeth 62 of rotary gear 56 to create a worm gear of drive guidance assembly 54 (see FIG. 2G). Rod 58 extends a width of ski simulator 52 from a first support block 64 to a second support block 66. Rod further includes a second spiral threaded section 68 and a third spiral threaded section 70. Ski Simulator 52 also includes a first pedal 72 and a second pedal 74. Each pedal 72, 74 includes a threaded hole 76. Threads of hole 76 of first pedal 72 are sized to engage second spiral threaded section 68 of rod 58. The rotating of rod 58 and threaded section 68 through threaded hole 76 allows first pedal 72 to travel side to side rod 58 (see FIG. 2H). Threads of hole 76 of second pedal 74 are sized to engage third spiral threaded section 70 of rod 58. The rotating of rod 58 and threaded section 70 through threaded hole 76 allows second pedal 74 to travel side to side about rod 58 (see FIG. 2I).

Ski simulator 52 further includes a frame 78 that anchors drive guidance assembly 54 and motor 12 and supports pedals 72, 74 as pedals travel side to side about rod 58 relative to frame 78. Frame 78 also includes a handle 80 and a seat 82 for supporting an individual exercising with ski simulator 52. Frame 78 may also include an anti-rotation bar 224 extending a length of frame 78 and positioned under pedals 72 and 44. Pedals may include an anti-rotation tab 222 on extending from a bottom of pedals 72 and 74 (see FIGS. 2L and 2M). Tab 222 may engage bar 224 while ski simulator is in operation to aid in preventing pedals 72 and 74 from rotating fore and aft as the pedals move side to side about rod 58 while ski simulator 52 is operational.

Ski simulator 52 may be operated in the following manner. An individual may engage ski simulator 52 by sitting on seat 82 and placing their hands on handle 80. The individual may place one foot on each of pedals 72 and 74. Much of the weight or load of the individual will be carried by seat 82. The feet may only lightly contact pedals 72 and 74. Each of pedals 72 and 74 will have a slight recessed area 84 to capture the feet of the individual. Recess 84 of each pedal 72 and 74 will provide tactile feedback to the individual through the feet as the pedals 72 and 74 move from side to side about simulator 52. This tactile feedback will inform the individual to move their feet along with pedals 72 and 74 during the exercise motion. With a significant portion of the weight of the individual supported by seat 82, specific muscles of the legs and hips may be targeted by the movements performed on ski simulator 52 to enhance and speed training, rehabilitation and recovery of those muscles.

In this particular embodiment of the present invention, a typical weight stack 50 including a plurality of weight plates 44 may be added to exercise apparatus 100 to provide assistance and resistance for the hip and leg muscles of the individual as legs are moved side to side about ski simulator 52. Weights plates 44 will provide assistance to the hip and leg muscles as the legs are brought together. Weights plates 44 will provide resistance to the hip and leg muscles as the legs move outward with respect to ski simulator 52. A cable 46 may be used to connect a cuff 86 at each ankle of the individual during exercise (see FIGS. 2A and 2B) to weight plates 44. The amount of assistance and resistance may be adjusted by increasing or decreasing the number of weight plates 44 in the stack. It is important to note that weight stack 50 may be substituted with a barbell, dumbbells, springs, bands (see FIGS. 2C and 2D) and the like and still provide assistance and resistance for the individual using ski simulator 52.

With individual positioned on ski simulator 52, apparatus 100 may be operated in the following manner. Electric motor 12 may be actuated to rotate rotary gear 56 in a first direction and induce a rotational motion in rod 58 to drive pedals 72 and 74 inward relative to ski simulator 52. As pedals 72 and 74 are driven inward by drive guidance assembly 54, the legs of the individual are also brought together thereby forcing cuffs 86 at the ankle inward and raising weight plates 44 of weight stack 50. Recesses 84 of pedals 72 and 74 provide tactile feedback to the individual through their feet to bring the legs together and use the hip and leg muscles to raise weight plates 44. The tactile feedback through the feet of the individual at pedals 72 and 74 provide information to the individual to follow the path of ski simulator 52 thereby causing the legs work to pull cables 46 against the resistance of the rising weights plates 44. Cables 46 are always in tension and applying a load to the legs through cuffs 86 as the legs are brought together. As motor 12 rotates to activate drive guidance assembly 54 and draw legs together, the muscles of the legs and hip are contracted or shorten to enable the individual to overcome the weight resistance and raise weight plates 44 relative to weight stack 50. The amount of time motor 12 is actuated to induce a rotation motion in rod 58 may also be adjusted to increase the travel of pedals 72 and 74 inward. The longer motor 12 is actuated to rotate rotary gear in a first direction, the more pedals 72 and 74 will be driven inward. Increasing the distance pedals 72 and 74 travel inward will also help to improve the flexibility of the individual.

With legs now brought together in a closed position, electric motor 12 may be actuated to rotate rotary gear 56 in a second direction and induce a reverse rotational motion in rod 58 to drive pedals 72 and 74 outward relative to ski simulator 52. As pedals 72 and 74 are driven outward by drive guidance assembly 54, the legs of the individual are also driven apart thereby forcing cuffs 86 at the ankle outward and lowering weight plates 44 of weight stack 50. Recesses 84 of pedals 72 and 74 provide tactile feedback to the individual through their feet to drive the legs apart and use the hip and leg muscles to lower weight plates 44. The tactile feedback through the feet of the individual at pedals 72 and 74 provide information to the individual to have their feet follow the path of pedals 72 and 74 thereby causing the legs to reduce the pulling force on cables 46 and lower weights plates 44. Cables 46 still remain in tension and apply a load to the legs through cuffs 86 as the legs are driven apart. As motor 12 rotates to activate drive guidance assembly 54 and drive legs apart, the muscles of the legs and hip are expanded or lengthened to enable the individual to lower weight plates 44 relative to weight stack 50. The amount of time motor 12 is actuated to induce a reverse rotation motion in rod 58 may also be adjusted to increase the travel of pedals 72 and 74 outward. The longer motor 12 is actuated to rotate rotary gear in a second direction, the further pedals 72 and 74 will be driven apart. Increasing the distance pedals 72 and 74 travel apart will also help to improve the flexibility of the individual. It is this shortening and lengthening of the hip and leg muscles during the exercise that enable the muscles to repair and strengthen enabling the individual to heal and improve their overall health. Further, apparatus 100 will enable individuals to exercise hip and leg muscles through isometric exercises when motor 12 is stopped for a period of time to hold pedals 72 and 74 at one or more predetermined locations.

In a typical exercise apparatus utilizing weight plates, the amount of resistance may be adjusted by selecting the number of weight plates the individual desires to move. Generally, an increase in the number of weight plates secured to the weight stack will increase the weight and overall resistance the individual must overcome to move the weight stack. The same concept may be used in this particular embodiment of the present invention. The prescribing physical therapist or individual user of exercise apparatus 100 may determine how much resistance to be increased or decreased for the muscles of the legs and hips while exercising with ski simulator 52 by selecting the number of weight plates 44 lowered and raised on stack 50. Allowing for an adjustment in the weight to be moved, will provide for a broader range of exercise capability to facilitate training of the muscles and aid and speed recovery and rehabilitation in an effort to improve health.

Figure 2A:
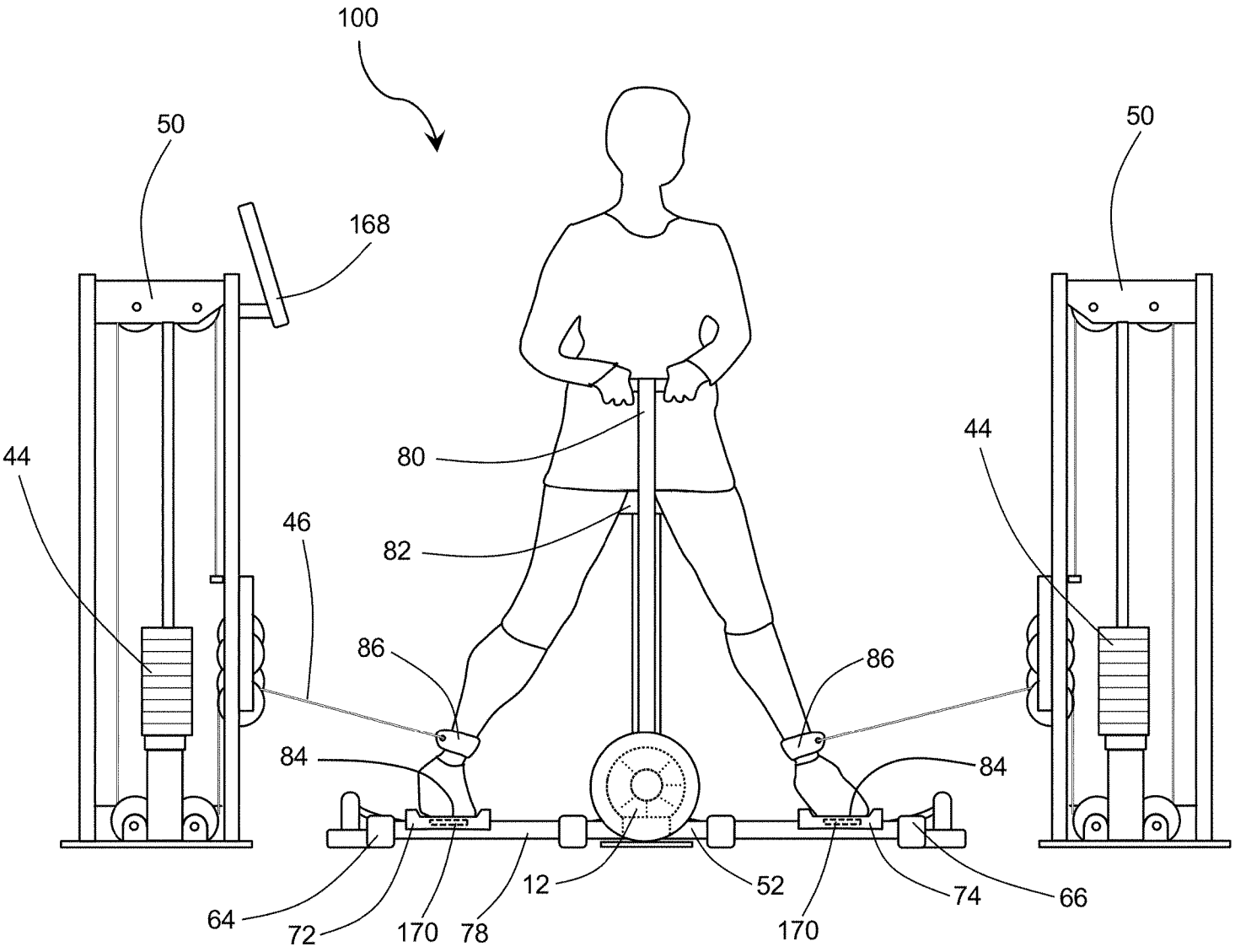
FIGS. 2A and 2B are front views of a motorized guidance exercise apparatus according to another embodiment of the present invention.
Figure 2B:
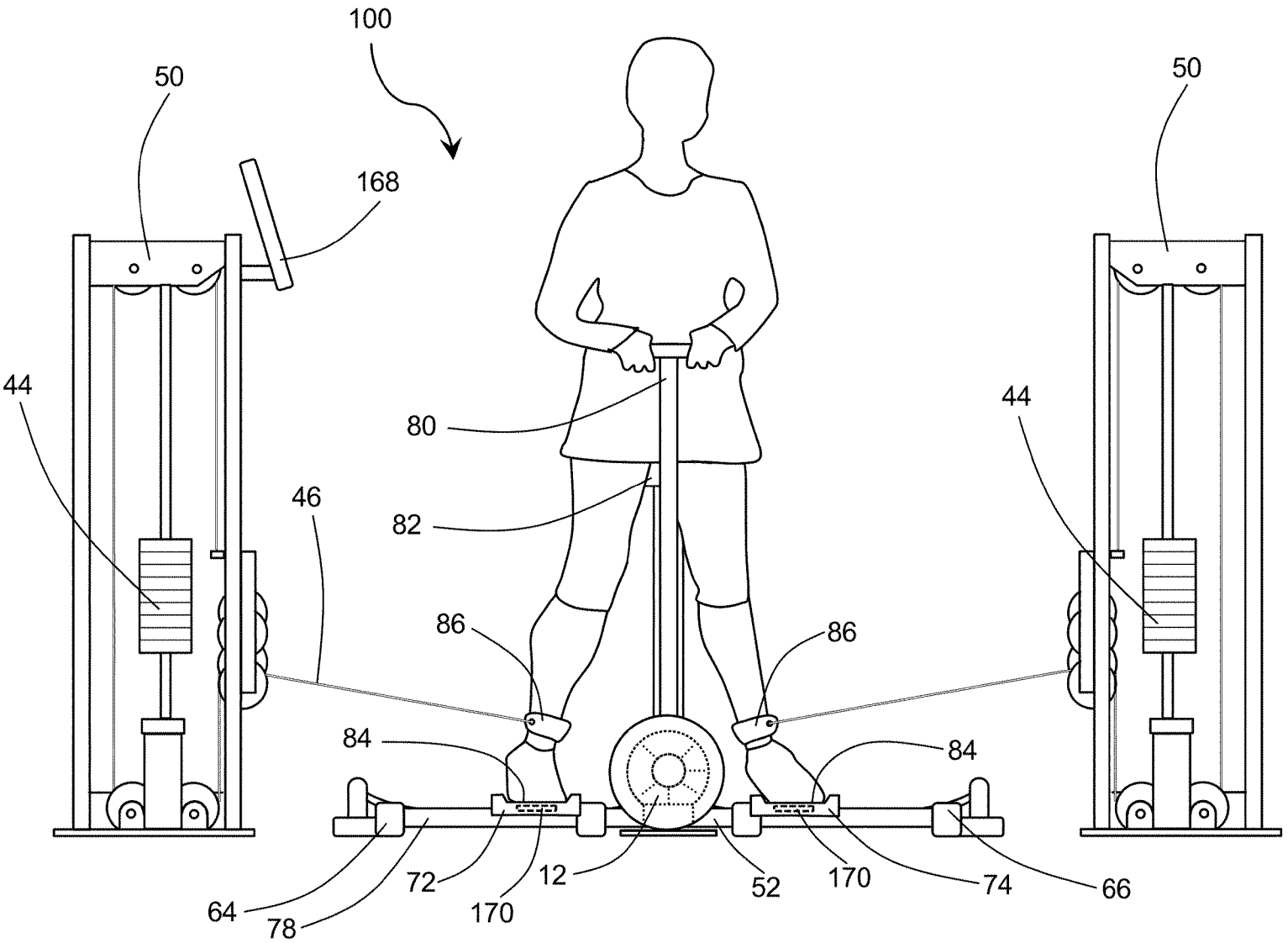
Figure 2C:
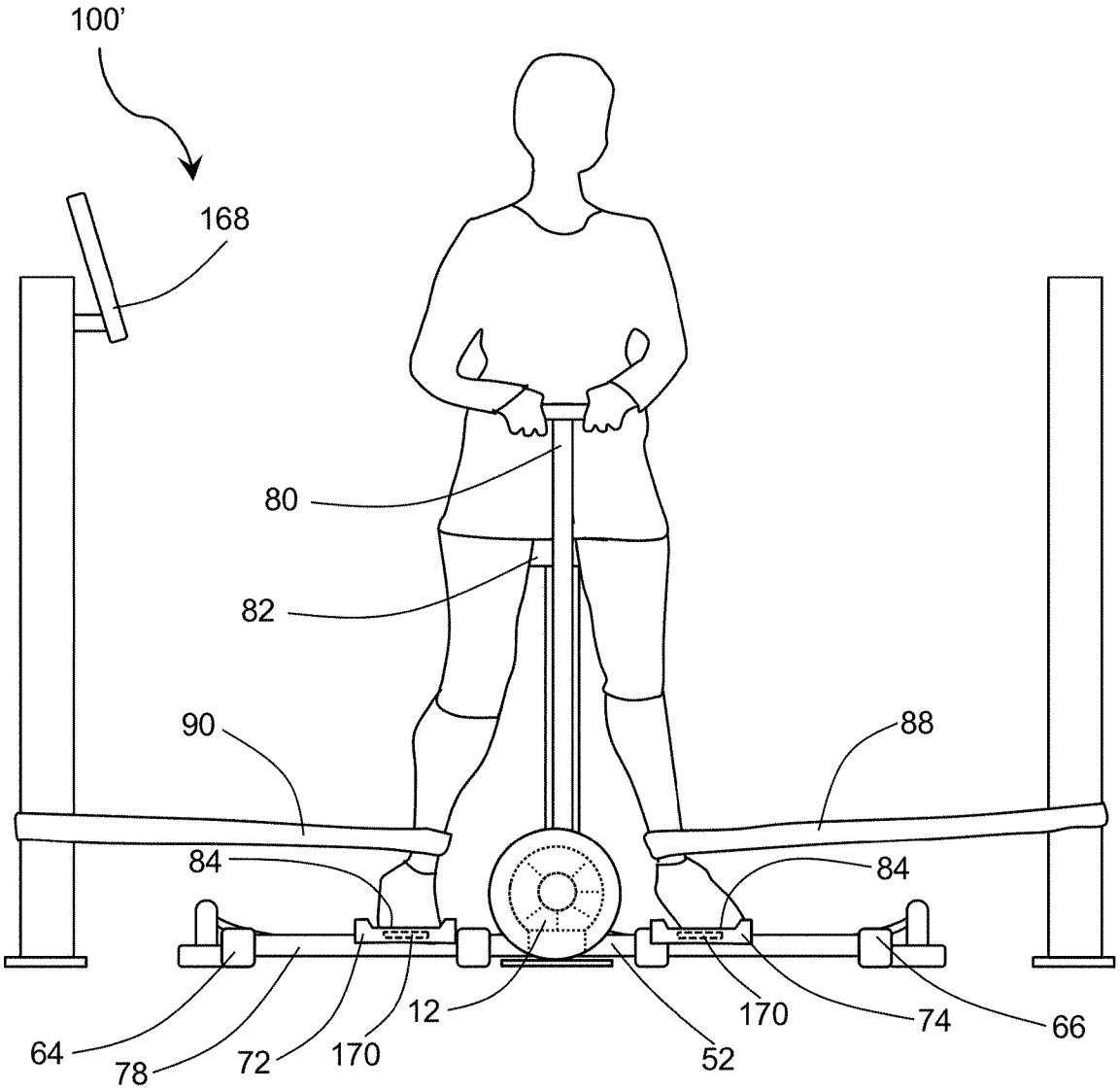
FIGS. 2C and 2D are front views of a motorized guidance exercise apparatus according to still another embodiment of the present invention.
Figure 2D:
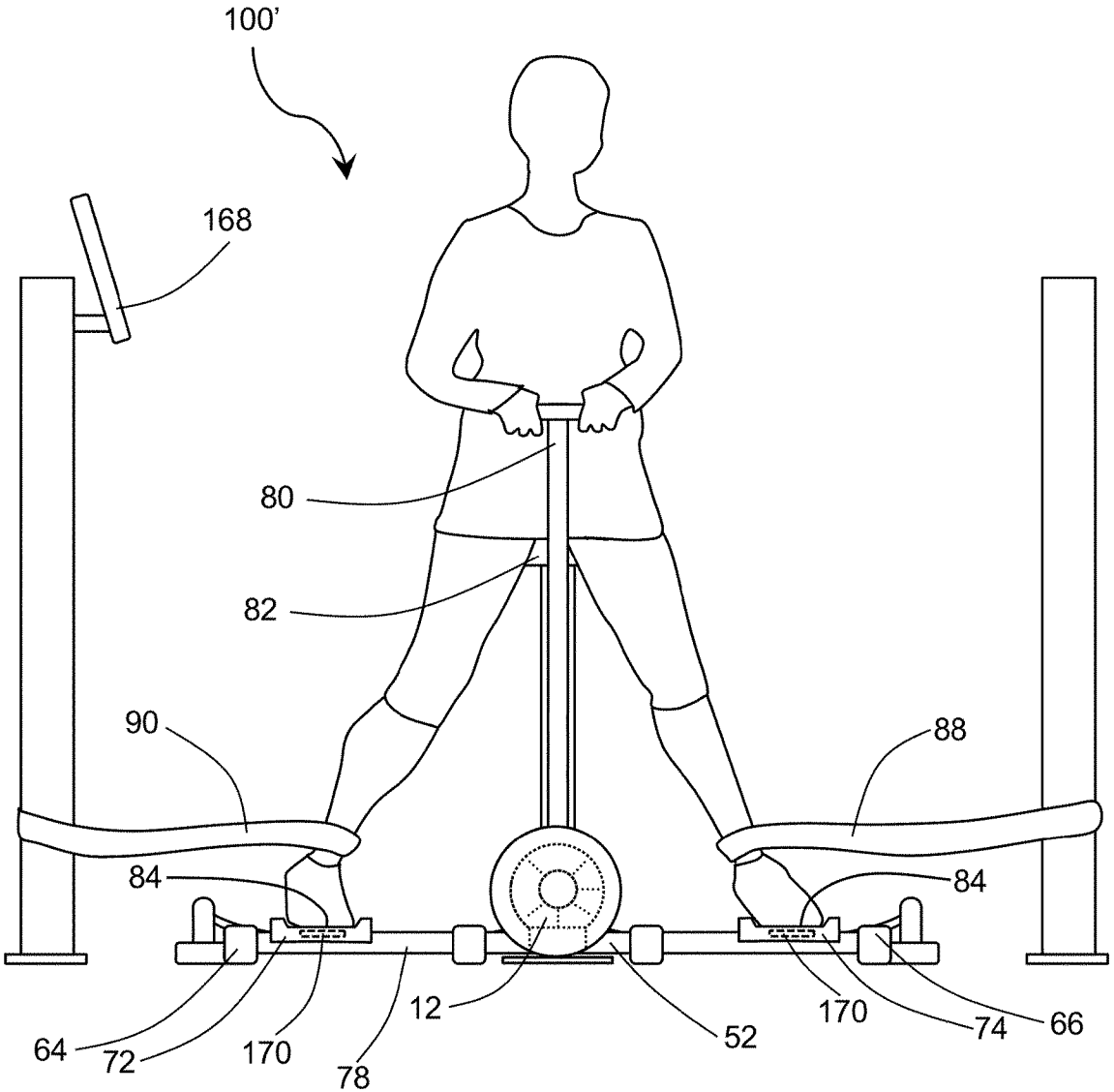
Figure 2E:
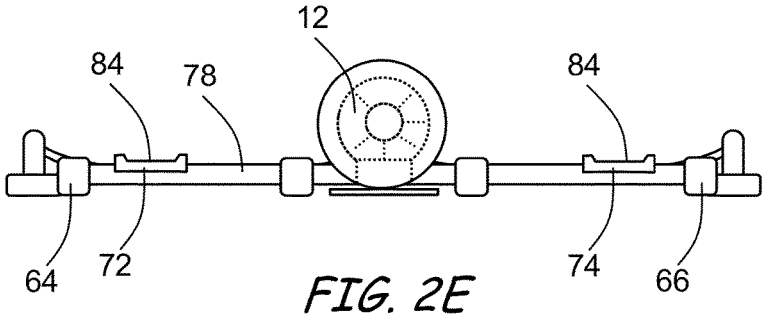
FIG. 2E is a front view of the motorized guidance exercise apparatus depicted in FIGS. 2A-2D.
Figure 2F:
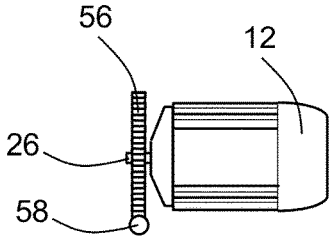
FIG. 2F is a side view of an electric motor and a gear set of the motorized guidance exercise apparatus depicted in FIGS. 2A-2D.
Figure 2G:
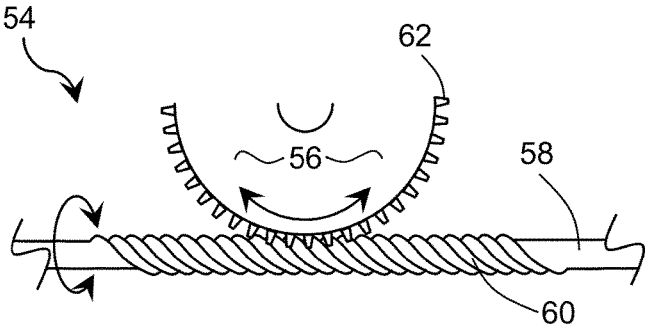
FIG. 2G is a front view of the gear set of the motorized guidance exercise apparatus depicted in FIGS. 2A-2D.
Figure 2H:
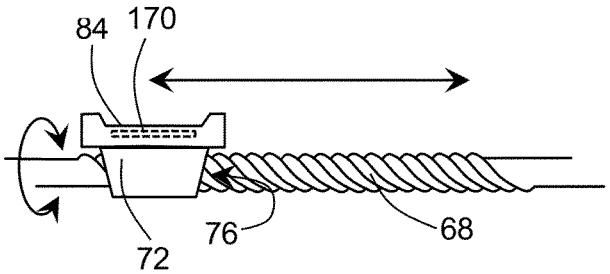
FIGS. 2H and 2I are front views of the gear and an interface member of the motorized guidance exercise apparatus depicted in FIGS. 2A-2D.
Figure 2I:
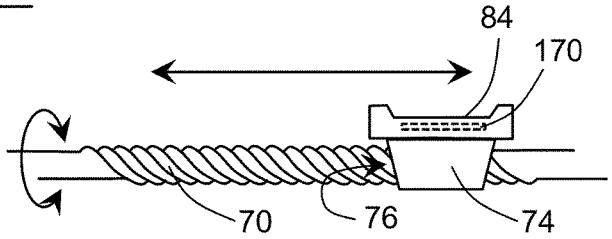

Now referring to FIGS. 2C and 2D, in another embodiment of the present invention, weight stack 50 of motorized guidance exercise apparatus 100' may be replaced with bands 88 and 90. Bands 88 and 90 may be secured at the ankles of the individual as illustrated in FIGS. 2C and 2D. Bands 88 and 90 will provide resistance to the hip and leg muscles of the individual as the legs of the individual travel through the exercise movement of ski simulator 52 described above. The resistance of bands 88 and 90 on the hip and leg muscles may be increased by adding more bands or increasing the thickness of the bands.

With individual positioned on ski simulator 52, apparatus 100' may be operated in the following manner. Electric motor 12 may be actuated to rotate rotary gear 56 in a first direction and induce a rotational motion in rod 58 to drive pedals 72 and 74 inward relative to ski simulator 52. As pedals 72 and 74 are driven inward by drive guidance assembly 54, the legs of the individual are also brought together thereby forcing bands 88 and 90 at the ankle inward and increasing the resistance of the bands on the hip and leg muscles. Recesses 84 of pedals 72 and 74 provide tactile feedback to the individual through their feet to bring the legs together and use the hip and leg muscles to increase the resistance of bands 88 and 90. The tactile feedback through the feet of the individual at pedals 72 and 74 provide information to the individual to follow the path of ski simulator 52 thereby causing the legs to pull bands 88 and 90 tighter. Bands 88 and 90 are always in tension and applying a load to the legs as the legs are brought together. As motor 12 rotates to activate drive guidance assembly 54 and draw legs together, the muscles of the legs and hip are contracted or shorten to enable the individual to increase the resistance of bands 88 and 90. The amount of time motor 12 is actuated to induce a rotation motion in rod 58 may also be adjusted to increase the travel of pedals 72 and 74 inward. The longer motor 12 is actuated to rotate rotary gear in a first direction, the more pedals 72 and 74 will be driven inward. Increasing the distance pedals 72 and 74 travel inward will also help to improve the flexibility of the individual.

With legs now brought together in a closed position, electric motor 12 may be actuated to rotate rotary gear 56 in a second direction and induce a reverse rotational motion in rod 58 to drive pedals 72 and 74 outward relative to ski simulator 52. As pedals 72 and 74 are driven outward by drive guidance assembly 54, the legs of the individual are also driven apart thereby forcing bands 88 and 90 at the ankle outward reducing the load on the hip and leg muscles. Recesses 84 of pedals 72 and 74 provide tactile feedback to the individual through their feet to drive the legs apart and use the hip and leg muscles to reduce the resistance on bands 88 and 90. The tactile feedback through the feet of the individual at pedals 72 and 74 provide information to the individual to have their feet follow the path of pedals 72 and 74 thereby causing the legs to reduce the pulling force on bands 88 and 90. Bands 88 and 90 still remain in tension and apply a load to the legs through as the legs are driven apart. As motor 12 rotates to activate drive guidance assembly 54 and drive legs apart, the muscles of the legs and hip are expanded or lengthened to enable the individual to reduce the resistance in bands 88 and 90. The amount of time motor 12 is actuated to induce a reverse rotation motion in rod 58 may also be adjusted to increase the travel of pedals 72 and 74 outward. The longer motor 12 is actuated to rotate rotary gear in a second direction, the further pedals 72 and 74 will be driven apart. Increasing the distance pedals 72 and 74 travel apart will also help to improve the flexibility of the individual. It is this shortening and lengthening of the hip and leg muscles during the exercise that enable the muscles to repair and strengthen enabling the individual to heal and improve their overall health.

Figure 2J:
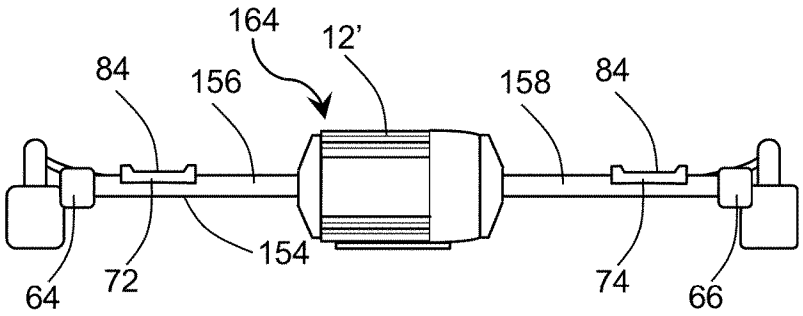
FIGS. 2J and 2K are front views of an electric motor and a gear set of a motorized guidance apparatus according to another embodiment of the present invention.
Figure 2K:
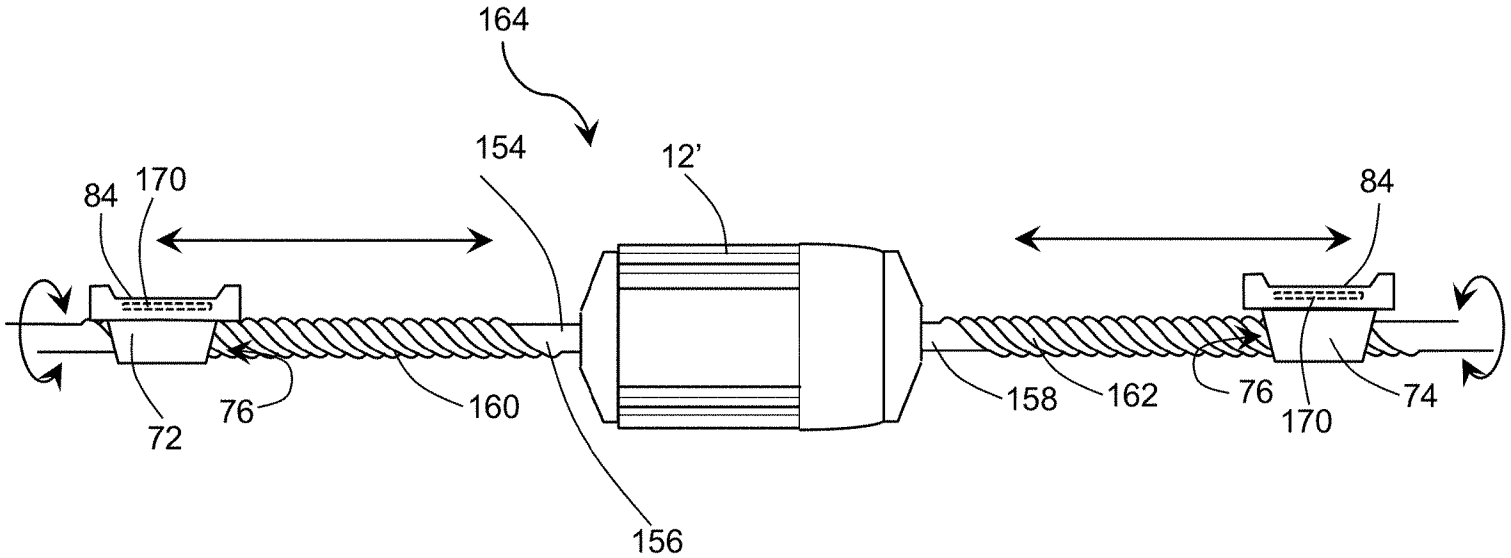
Figure 2L:
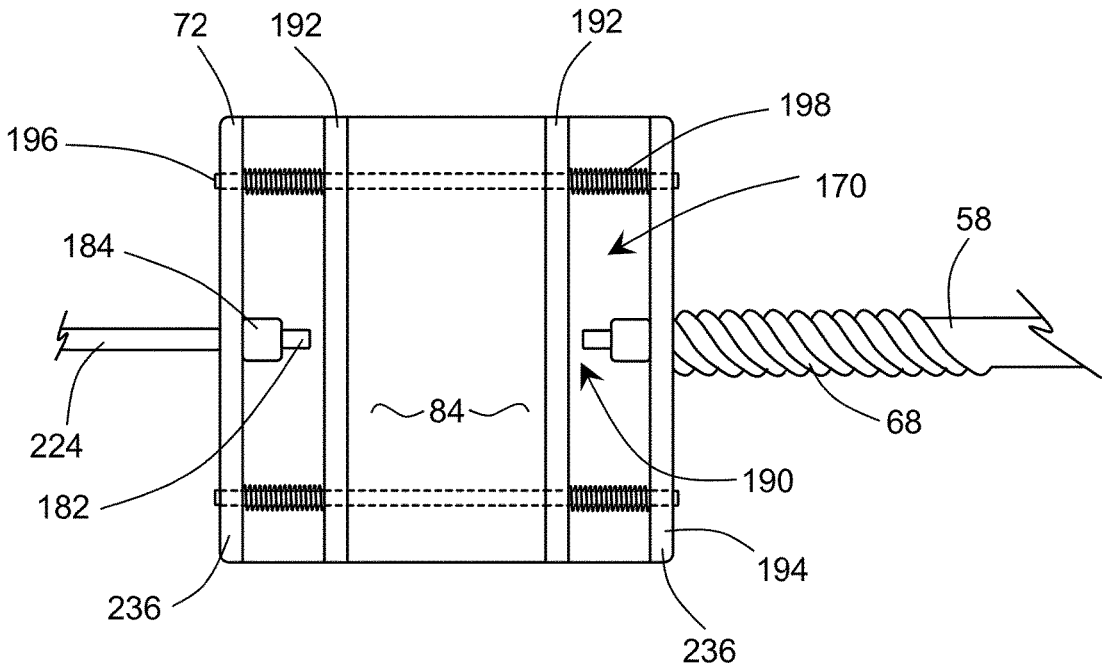
FIG. 2L is a top view of a force sensor of a pedal of the motorized guidance exercise apparatus depicted in FIGS. 2A-2D.
Figure 2M:
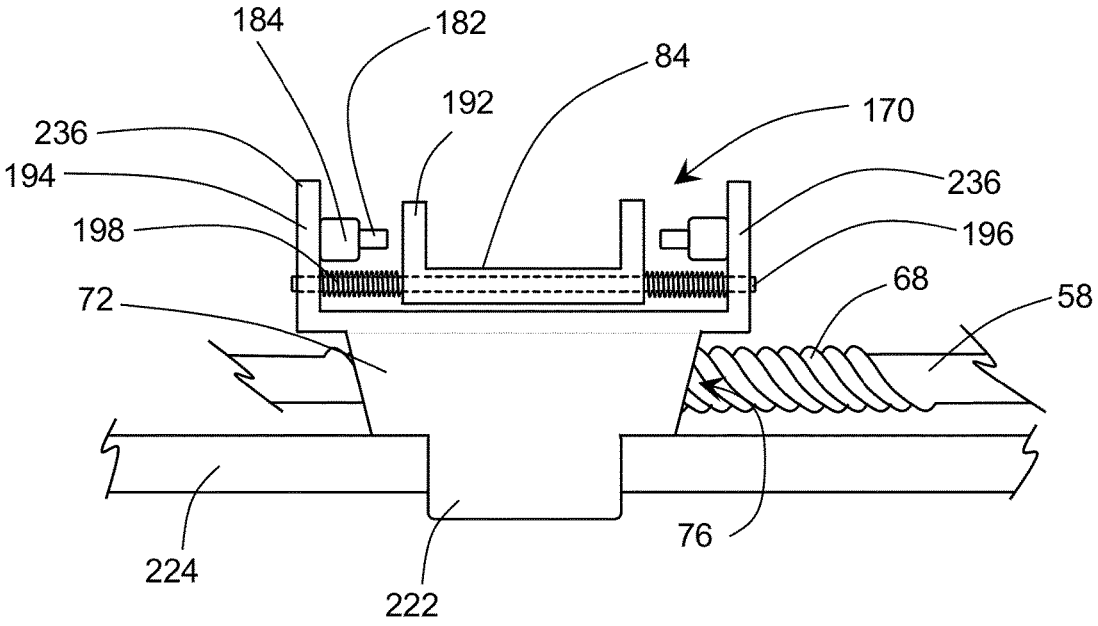
Figure 2N:
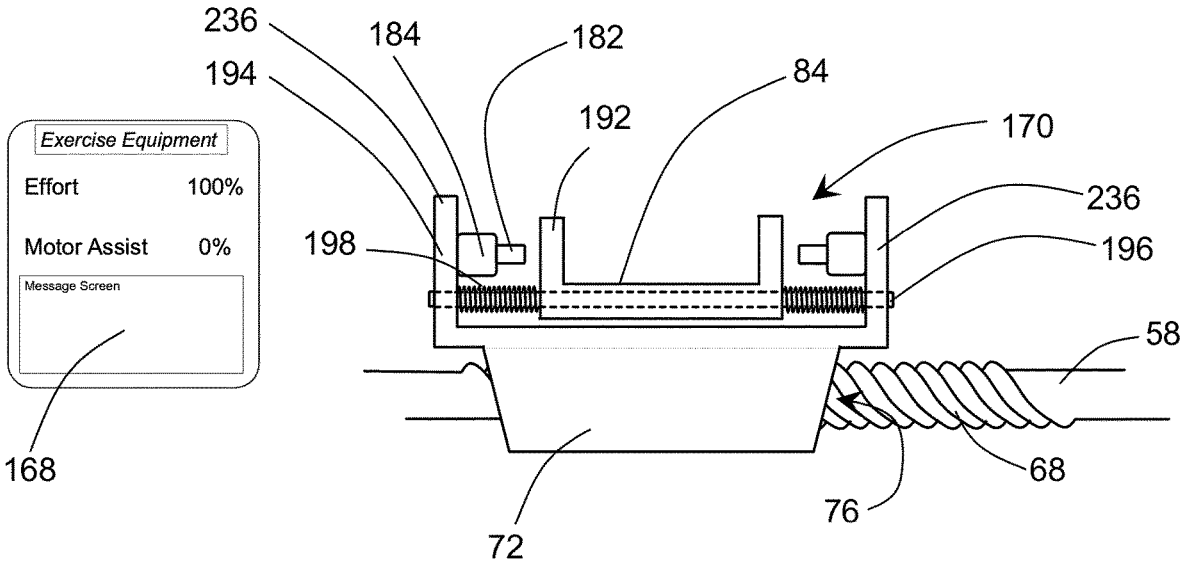
Figure 2O:
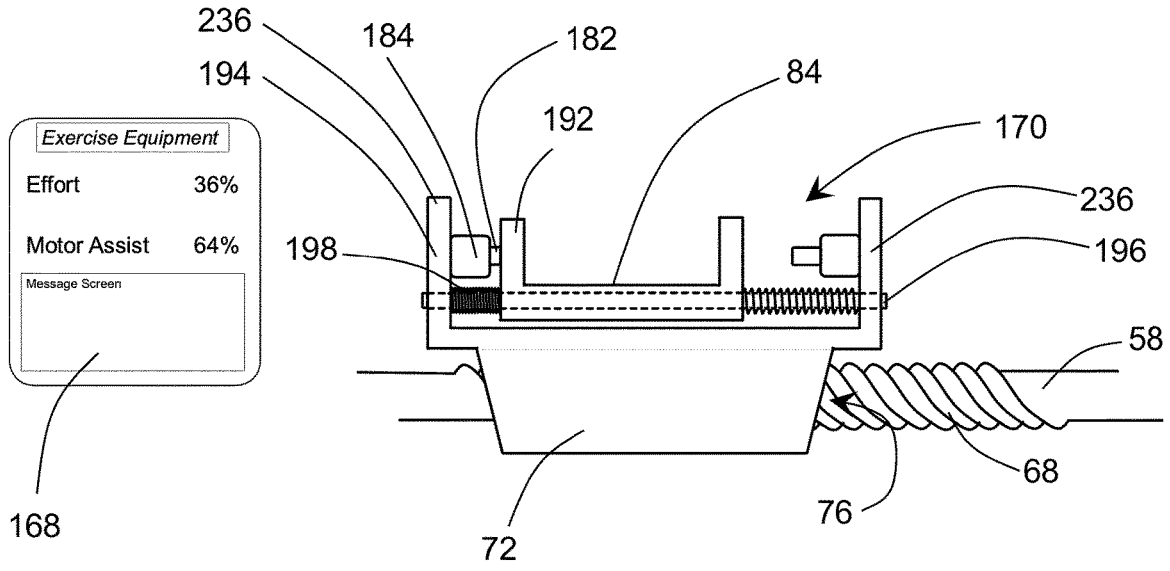

Referring now to FIGS. 2J and 2K, motor 12' may be rotated 90 degrees relative to apparatus to ski simulator 52 such that the rotation of motor 12 is in line with drive guidance assembly 164 to enhance motorized guidance exercise apparatus 100 and exercise apparatus 100'. In this particular embodiment of the present invention, drive guidance assembly 164 may include a first rod 156 extending outward from motor 12' in a first direction. Drive guidance assembly 164 may also include a second rod 158 extending outward from motor 12' in a second, opposite, direction from rod 156. First rod 156 may include a spiral threaded section 160 and second rod 158 may also include a spiral threaded section 162. First rod 156 extends from motor 12' to support block 64 and second rod 158 extends from motor 12' to second support block 66. Threads of hole 76 of first pedal 72 are sized to engage spiral threaded section 160 of first rod 156. The rotating of first rod 156 and threaded section 160 through threaded hole 76 allows first pedal 72 to travel side to side about first rod 156. Threads of hole 76 of second pedal 74 are sized to engage spiral threaded section 162 of second rod 158. The rotating of second rod 158 and threaded section 162 through threaded hole 76 allows second pedal 74 to travel side to side about rod 158.

Motor 12' and drive guidance assembly 164 are secured to frame 78 that supports pedals 72, 74 as pedals travel side to side about first rod 156 and second rod 158 relative to frame 78. Frame 78 also includes a handle 80 and a seat 82 for supporting an individual exercising with ski simulator 52. Motorized apparatus 100 and motorized apparatus 100' may be operated as detailed above with motor 12' and drive guidance assembly 164.

Referring now to FIGS. 2L-20, a force sensor 170 may be included in each of pedals 72 and 74 at recesses 84 to indicate to the individual, through monitor 168, the amount of force the individual is applying to pedals 72 and 74 during the exercise motion. As stated above, the individual may need to exert more effort in terms of energy by the human body to maintain a light contact with pedals 72 and 74 as pedals 72 and 74 travel inward and outward about ski simulator 52 by motor 12 or 12' and drive guidance assembly 54 or 164 and weight plates 44 are lowered on weight stack 50 or bands 88 and 90 are expanded and contracted. In this instance, the force against sensors 170 may be low and the human "Effort" reading on monitor 168 (see FIG. 5) may be high, for example close to 100% and the "Motor Assist" reading may be low, for example close to 0%. This would indicate to the individual that they are using their muscles at near maximum effort during the exercise to follow the motion of pedals 72 and 74, rather than relying on support from pedals 72 and 74 and motor 12, resulting in near optimal development of the subject muscles in the legs and hips. Conversely, the individual may rely on pedals 72 and 74 for assistance to move pedals 72 and 74 inward and outward about ski simulator 52. In this instance, the force against sensors 170 may be high and the human "Effort" reading on monitor 168 may be low, for example close to 50% and the "Motor Assist" reading may be high, for example close to 50%. This would indicate to the individual that they are using their muscles at near minimal effort during the exercise as their feet are moved by pedals 72 and 74 and motor 12 rather than having their feet apply only light force against pedals 72 and 74 and following the motion of pedals 72 and 74 such that the leg and hip muscles are doing much of the work rather than motor 12. The effort information provided on monitor 168 may be used by the individual user of exercise apparatus 100 or 100', prescribing physical therapist, trainer, prescribing physician and others to guide development of the leg and hip muscles to speed rehabilitation and improve overall health of the individual.

Force sensor 170 may include a pair of force plates 192 and a support plate 194, support plates 194 being fixedly secured to pedals 72 and 74 at edges and including a pair of legs 236. A pair of guide rods 196 are inserted into a pair of compression springs 198 and both are connected to legs 236 of support plate 194 and capture force plates 192 to pedals 72 and 74 thereby allowing force plates 192 to slide freely on pedals 72 and 74 and between legs 236 of support plate 194. Force gauge plungers 182 and force gauges 184 are positioned are secured to each of legs 236 of support plate 194 as illustrated in FIGS. 2L-20. The tension in compression springs 198 maintain a gap 190 between force plates 192 and force gauge plungers 182. Gap 190 enables the individual to experience the tactile feedback from pedals 72 and 74. As detailed above, the individual will expend effort in the form of leg muscle fatigue to maintain gap 190 and not activate plungers 182 and force gauges 184 as pedals 72 and 74 move side to side about apparatus 100, thereby maximizing their effort expended as indicated on monitor 168. If the individual fatigues and cannot maintain gap 190, force plates 192 will contact and engage plunger 182. Pedals 72 and 74 of ski simulator 52 and motor 12 will begin to increase the amount of work expended to move the legs of the individual from an open stance to a closed stance and the individual will expend less energy. As the individual fatigues further, plunger 182 descends deeper into force gauge 184 resulting in even less energy expended by the individual and more work done by motor 12. As force plates 194 contact plungers 182, force measurements are taken and results displayed on monitor 168. Once again, the effort information provided on monitor 168 may be used by the individual user of exercise apparatus 100 or 100', prescribing physical therapist, trainer, prescribing physician and others to guide development of the abdomen muscles to speed rehabilitation and improve overall health of the individual.

In still another embodiment of the present invention illustrated in FIGS. 3A-3H, electric motor 12*a* may be added to a calf raise machine 92 to enable motorized guidance exercise apparatus 200. A second electric motor 12*b* may be added to calf raise machine 92 to allow each leg to be exercised either together or independently depending on the exercise protocol. Calf raise machine 92 may include a frame 94 and a horizontal brace 96 that may be secured to frame 94 at a pivot point 98. Pivot point 98 may include a bar 102 that secures frame 94 to horizontal brace 96 and allows brace 96 to rotate about frame 94. Brace 96 includes a seat 104 to support an individual in a seated position while operating machine 92. Brace 96 further includes thigh pads 106*a*, 106*b* to engage the thighs of the individual while operating machine 92 and a sleeve 108 to secure a weight plate 110 to brace 96 and machine 92. Frame 94 further includes a stanchion 112 to support the front end of brace 96 when brace 96 is in a lowered position relative to frame 94.

Figure 3A:
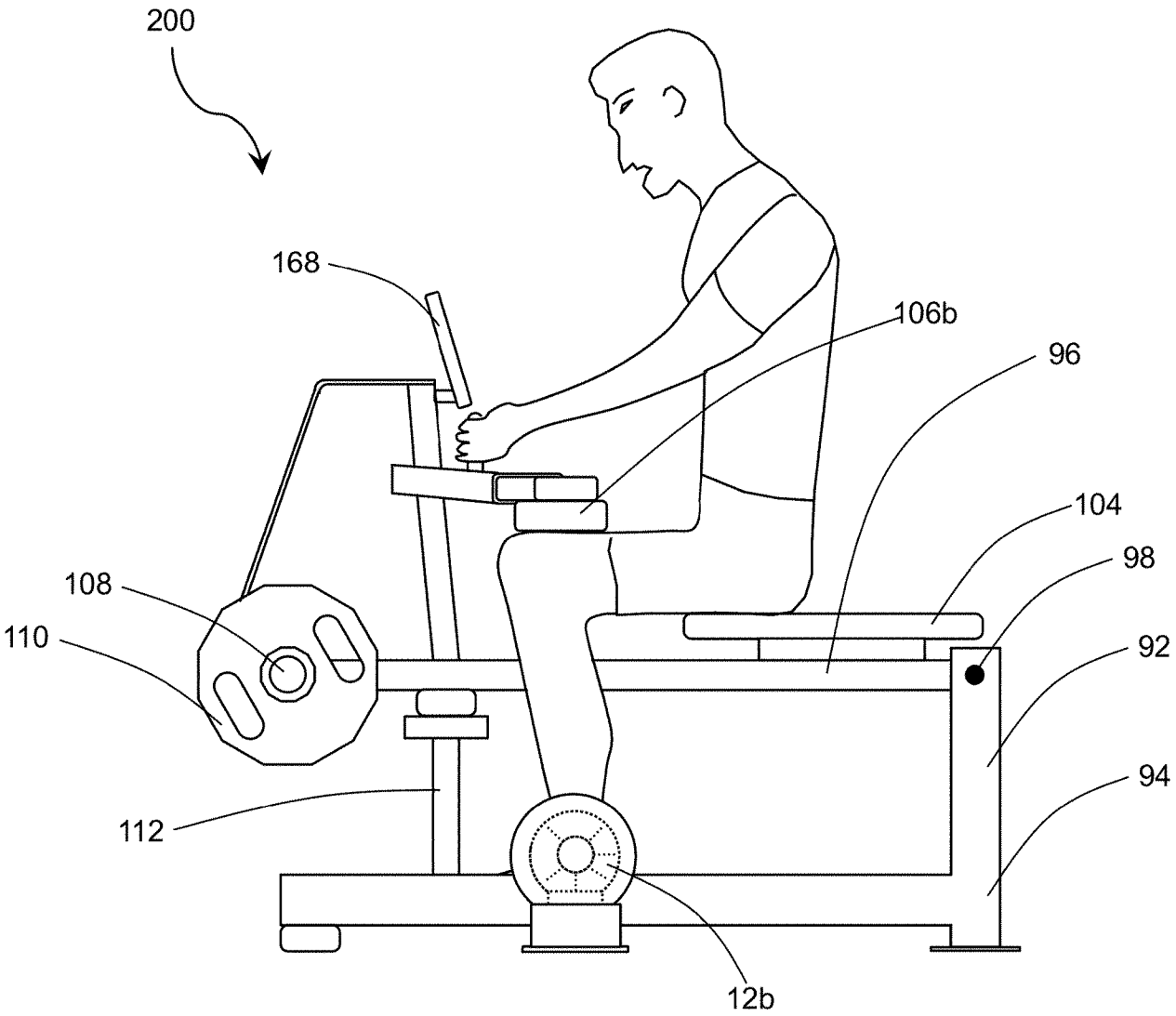
FIGS. 3A and 3B are side views of a motorized guidance exercise apparatus according to yet another embodiment of the present invention.
Figure 3B:
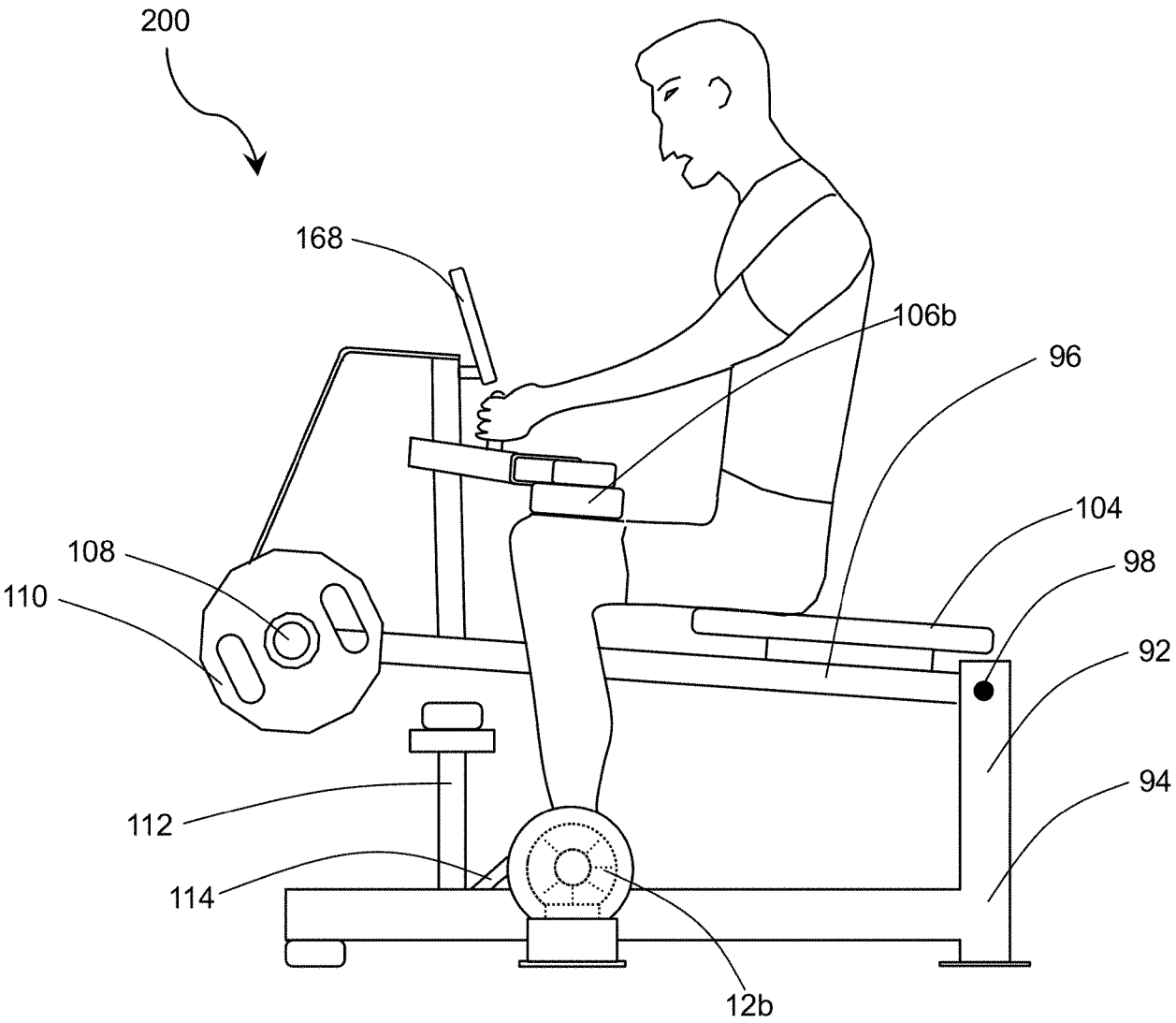
Figure 3C:
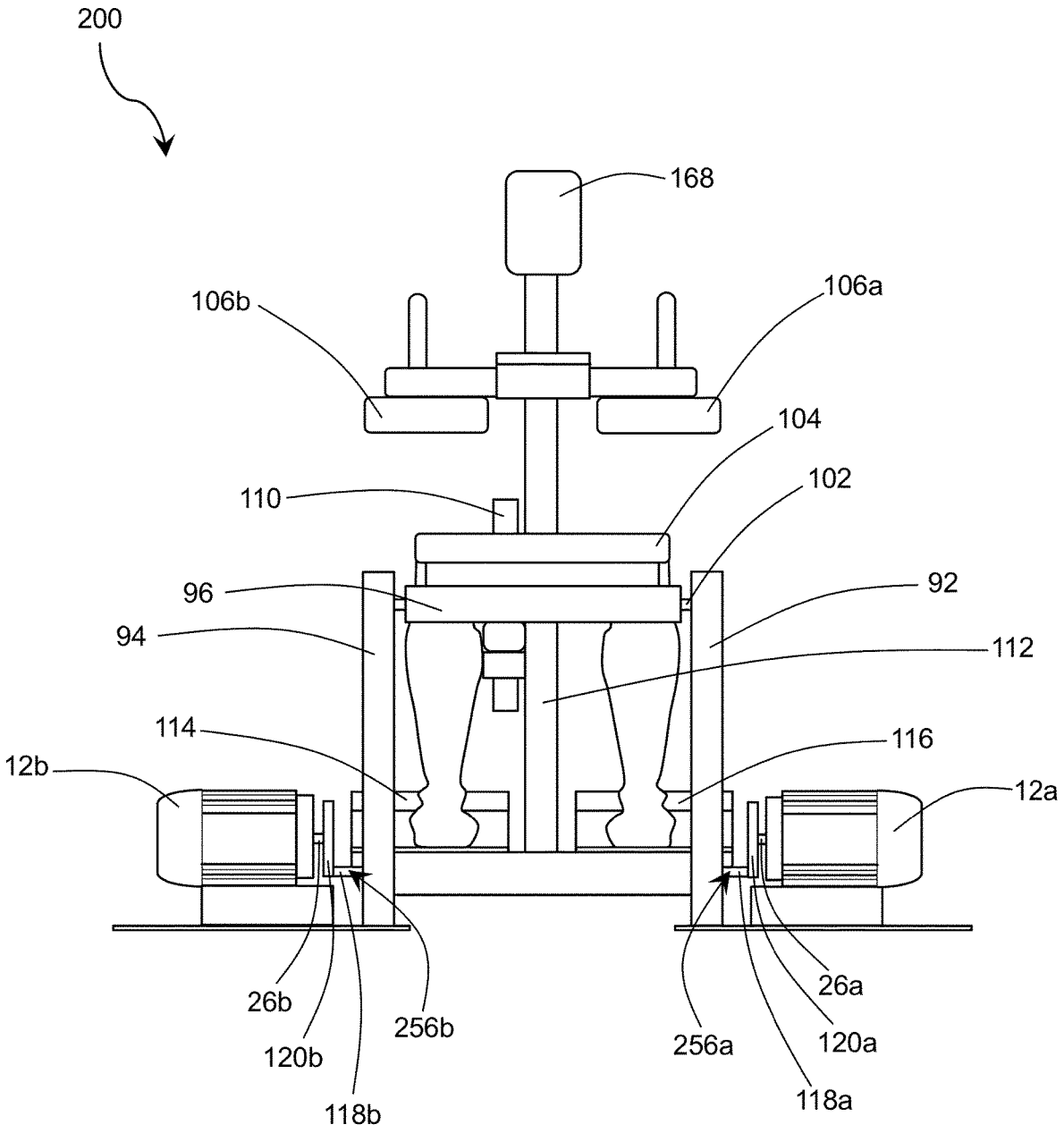
FIGS. 3C-3E are rear views of a motorized guidance exercise apparatus depicted in FIGS. 3A and 3B according to another embodiment of the present invention.
Figure 3D:
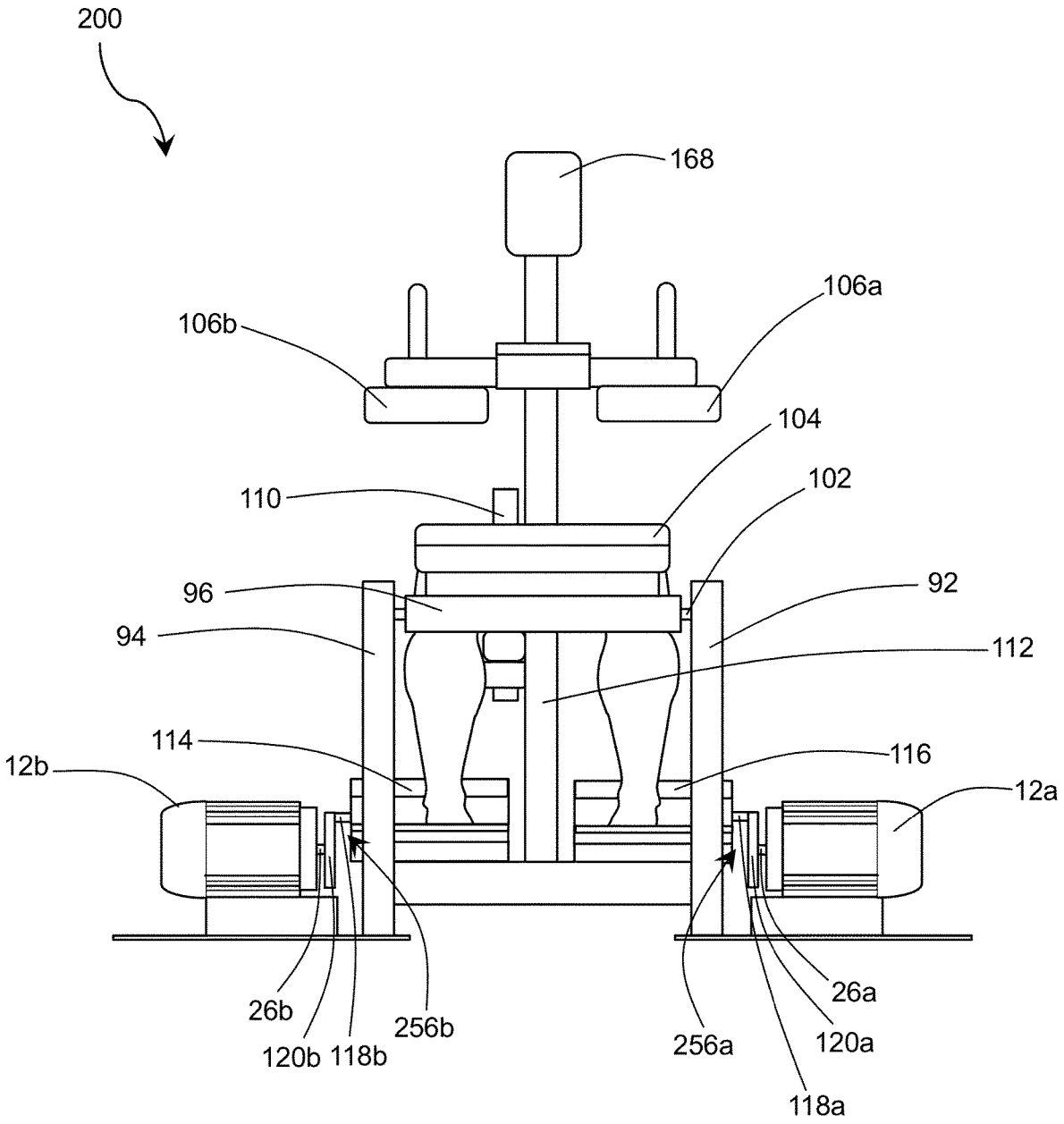
Figure 3E:
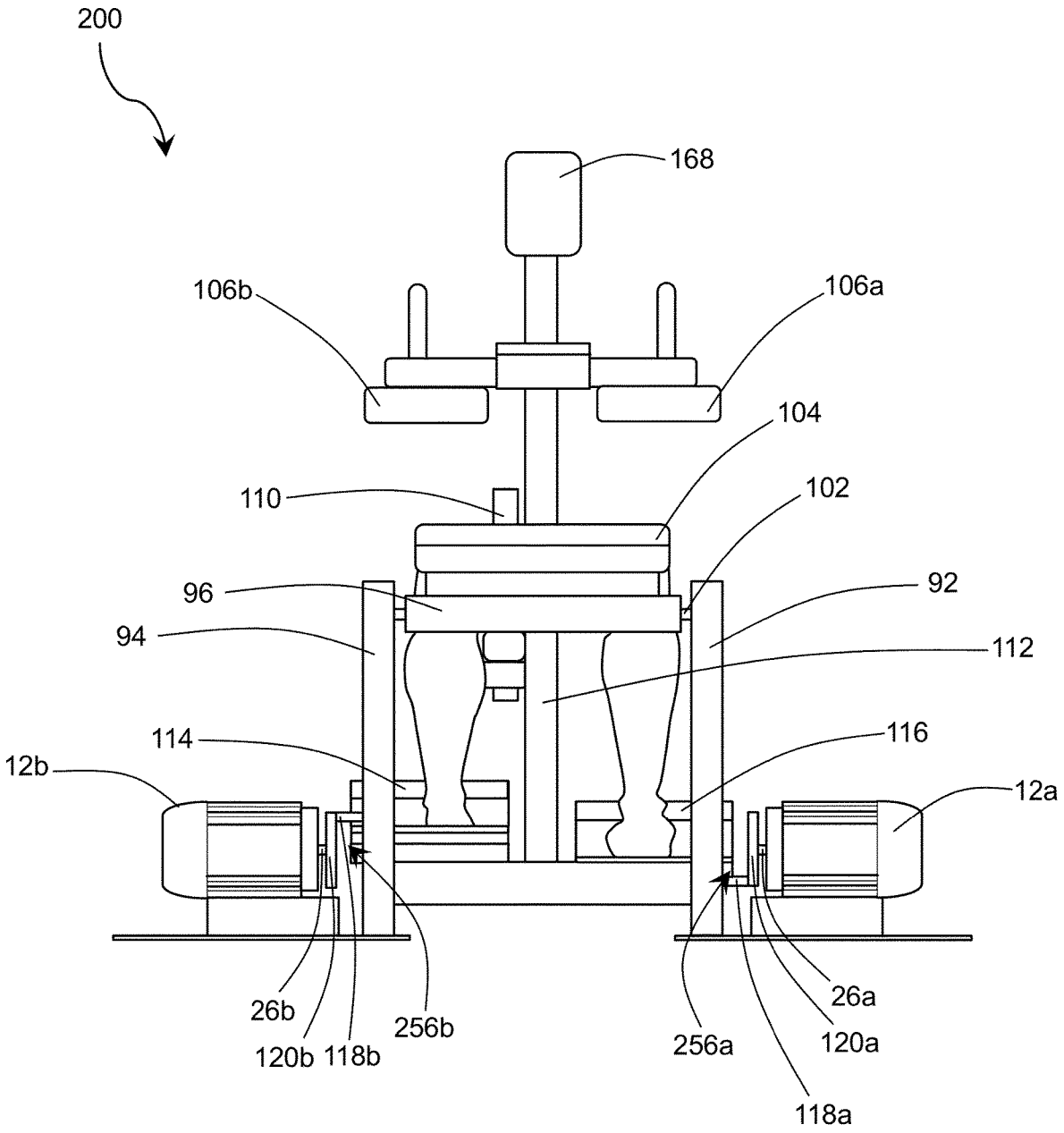
Figure 3F:
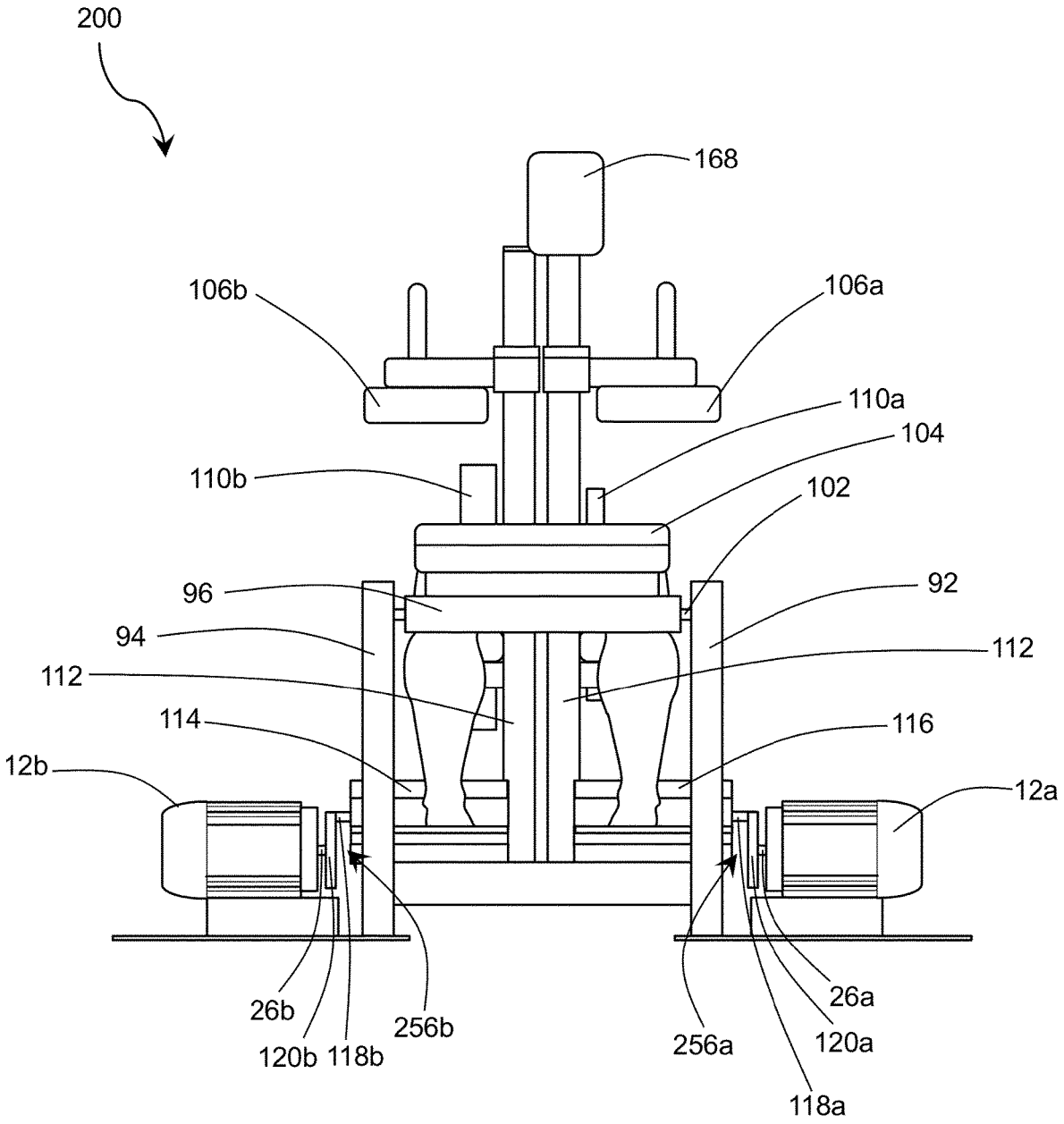
FIG. 3F is a rear view of a motorized guidance exercise apparatus depicted in FIGS. 3A and 3B according to still another embodiment of the present invention.
Figure 3G:
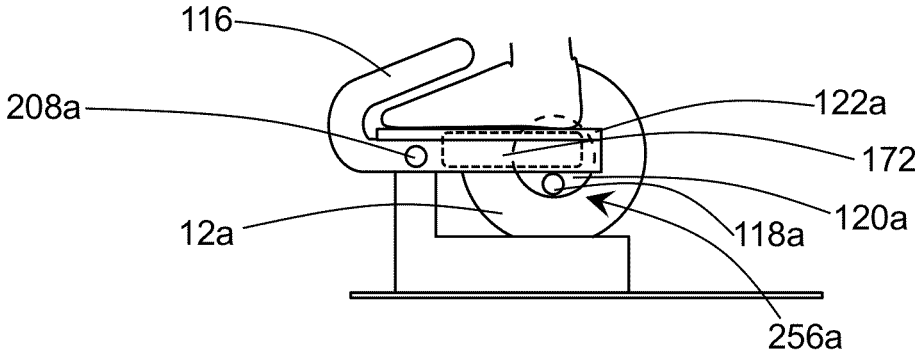
FIGS. 3G and 3H are side views of a foothold and motor of the motorized guidance exercise apparatus depicted in FIGS. 3A-3F.
Figure 3H:
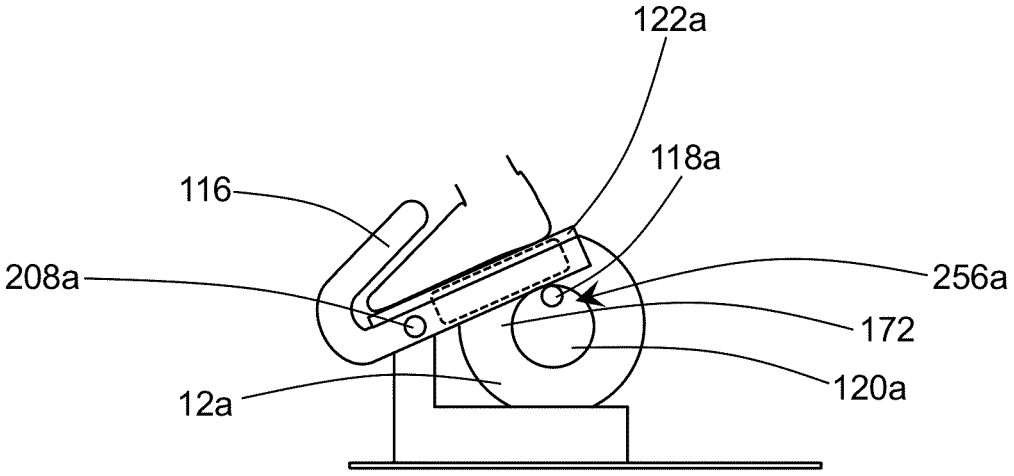
Figure 3I:
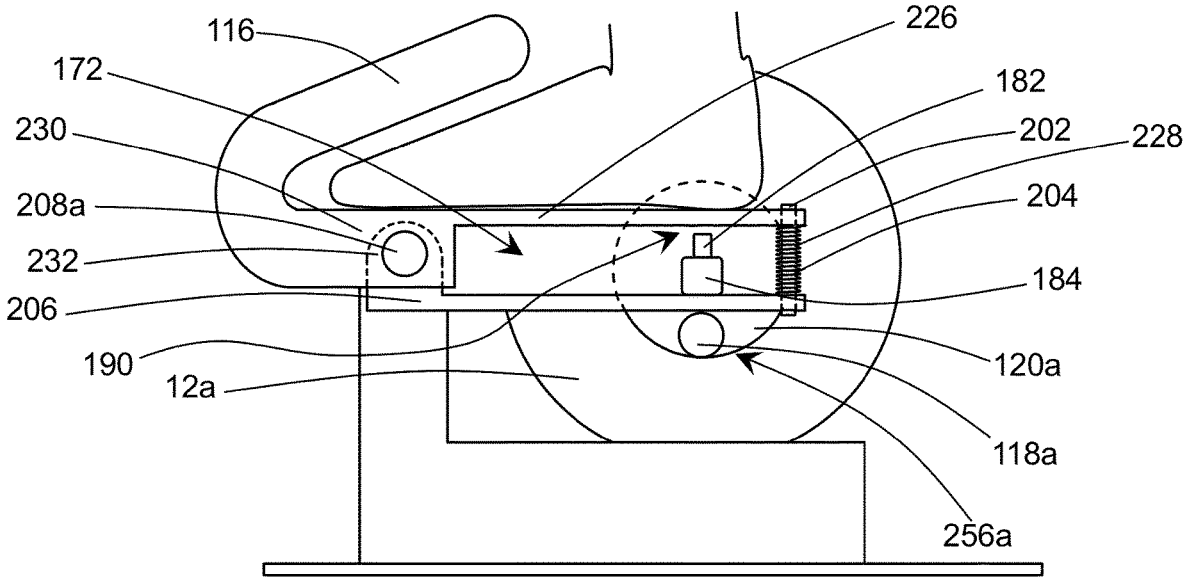

Calf raise machine 92 also includes footholds 114 and 116 sized to accept and secure the feet of an individual to calf raise machine 92 (see FIGS. 3G and 3H). Footholds 114 and 116 are also secured to electric machines 12*a*, 12*b* by shafts 26*a*, 26*b* through drive guidance assemblies 256*a*, 256*b*. Drive guidance assemblies 256*a*, 256*b* may include shafts 118*a*, 118*b* at flywheels 120*a*, 120*b* to secure footholds 116, 114 to electric machines 12*a*, 12*b*. Shafts 118*a*, 118*b* rest directly below the heels of the feet. Drive guidance assemblies 256*a*, 256*b* may also include shafts 208*a* and 208*b* (not shown) that secure footholds 114 and 116 to frame 94 and enable footholds 114 and 116 to pivot in an up and down motion to raise and lower the heels of the feet. Shafts 208*a* and 208*b* (not shown) may be positioned below the balls of the feet. Footholds 114 and 116 may each include a rubber or urethane flat plate 122*a*, 122*b* positioned under the feet and extend from the front of the toes to the heel. As electric machines 12*a*, 12*b* are energized, machines 12*a*, 12*b* induce a rotary motion in flywheels 120*a*, 120*b* and shafts 118*a*, 118*b* of drive guidance assemblies 256*a*, 256*b* to raise and lower the heel of the foot in footholds 114 and 116.

Alternatively, cam lobes (not pictured) may be included in drive guidance assemblies 256*a*, 256*b* and attached at shafts 26*a*, 26*b* and positioned under the heels of the feet and footholds 114 and 116. As electric machines 12*a*, 12*b* are energized, machines 12*a*, 12*b* induce a rotary motion in cam lobes to raise and lower footholds 114 and 116. As footholds 114 and 116 are raised and lowered by electric machines 12*a*, 12*b*, the heels of the individual are also raised and lowered relative to the front of the feet.

Plates 122*a*, 122*b* will provide the individual with a light tactile feedback as footholds 114 and 116 are raised and lowered to direct the individual to raise and lower their heels relative to their feet. As the heels are raised, the calf muscles contract or shorten to raise the thighs of the individual in contact with thigh pads 106*a*, 106*b*. As thigh pads 106*a*, 106*b* is raised, an upward motion is induced in brace 96 relative to frame 94 of calf raise machine 92. As the heels are lowered, the calf muscles expand or lengthen and the thighs of the individual in contact with thigh pads 106*a*, 106*b* are also lowered to induce a downward motion in brace 96 as base 96 returns to stanchion 112 of frame 94.

In this particular embodiment of the present invention, a typical weight plate 110 may be added to calf raise machine 92 at sleeve to provide assistance and resistance for the calf muscles of the individual to raise and lower brace 96 relative to frame 94 of calf raise machine 92. Weights plate 110 will provide resistance to the calf muscles as the heels of the individual in footholds 114 and 116 are raised. Weights plate 110 will provide assistance to the calf muscles as the heels of the individual in footholds 114 and 116 are lowered relative to frame 94. It is important to note that weight plate 110 may be substituted with a barbell, dumbbells, springs, bands and the like and still provide assistance and resistance for the individual using calf raise machine 92. Maintaining a light contact between the heel and footholds 114 and 116 ensures optimal performance of the affected muscles during the exercise. It is this shortening and lengthening of the calf muscles during the exercise that enable the muscles to repair and strengthen enabling the individual to heal and improve their overall health. Increasing the distance the heel is raised relative to the foot by modifying the position of shafts 118*a*, 118*b* relative to motors 12*a*, 12*b* of apparatus 200 will also help to increase and improve the flexibility of the individual. Further, apparatus 200 will enable individuals to exercise calf muscles through isometric exercises when motors 12*a*, 12*b* are stopped for a period of time to hold footholds 114 and 116 at one or more predetermined locations.

In another embodiment of the present invention depicted in FIG. 3E, a single motor 12 of motorized guidance apparatus 200 may be energized to induce movement in a single foot and calf of the individual while exercising with calf raise machine 92. An exercise protocol may call for only a single calf to be exercised if the particular calf is undergoing rehabilitation and requires exercise to rebuild strength to match the strength of the opposite calf. In still another embodiment illustrated in FIG. 3F, calf raise machine 92 may be modified to allow each calf of the individual to exercise under a different level of resistance. In this particular embodiment, brace 96 may be split to allow for two different weight sleeves such that two different weight plates 110*a* and 110*b* may be used. One weight plate 110*b* may be a higher weight than weight plate 110*a* thereby allowing the muscles of one calf to exercise under a different resistance from the muscles of the other calf. This again will allow an individual with an injury or other damage to the muscles of one calf to rehabilitate at a lower weight than the muscles of the other calf thereby speeding recovery of the injured calf muscles.

Referring now to FIG. 31, a force sensor 172 may be included in each of footholds 116 and 114 to indicate to the individual, through monitor 168, the amount of force the individual is applying within footholds 116 and 114 during the exercise motion. As stated above, the individual may need to exert more effort in terms of energy by the human body to maintain a light contact within footholds 116 and 114 as footholds 116 and 114 are driven up and down on calf raise machine 92 by motors 12*a* and 12*b* and drive guidance assemblies 256*a* and 256*b* and as weight plates 110, 110*a* and 110*b* are raised and lowered. In this instance, the force against sensors 172 may be low and the human "Effort" reading on monitor 168 (see FIG. 5) may be high, for example close to 100% and the "Motor Assist" reading may be low, close to for example 0%. This would indicate to the individual that they are using their muscles at near maximum effort during the exercise to follow the motion of footholds 116 and 114, rather than relying on support from footholds 116 and 114 and motors 12*a* and 12*b*, resulting in near optimal development of the subject muscles in the calves. Conversely, the individual may rely on footholds 116 and 114 and motors 12*a* and 12*b*, for assistance to move footholds 116 and 114 up and down on calf machine 92. In this instance, the force against sensors 172 may be high and the human "Effort" reading on monitor 168 may be low, for example close to 50% and the "Motor Assist" reading may be high, for example close to 50%. This would indicate to the individual that they are using their muscles at near minimal effort during the exercise as their feet and calves are moved by footholds 116 and 114 and motors 12*a* and 12*b*, rather than having their feet apply only light force within footholds 116 and 114 and following the motion of footholds 116 and 114 such that the calf muscles are doing much of the work rather than motors 12*a* and 12*b*. The effort information provided on monitor 168 may be used by the individual user of exercise apparatus 200, prescribing physical therapist, trainer, prescribing physician and others to guide development of the calf muscles to speed rehabilitation and improve overall health of the individual.

Force sensor 172 may include a force plate 226 and a support plate 206 within each of footholds 114 and 116. A guide rod 202 is inserted into a compression spring 204 and are both are connected to force plate 226 and support plate 206 at a first end 228 of force sensor 172. A second end 230 of force plate 226 may be secured to calf raise machine 92 and at pivot point 208*a*. Second end 230 of force plate 226 may rotate about pivot point 208*a* relative to support plate 206. A second end 230 of support plate 206 may be secured to calf raise machine 92 and at pivot point 208*a* as well to allow support plate to rotate with footholds 114 and 116. A force gauge plunger 182 and force gauge 184 are positioned at first end 228 of force sensor 172 and secured to support plate 206. The tension in compression spring 204 maintains a gap 190 between force plate 226 and force gauge plunger 182. Gap 190 enables the individual to experience the tactile feedback from footholds 114 and 116. As detailed above, the individual will expend effort in the form of calf muscle fatigue to maintain gap 190 and not activate plunger 182 and force sensor 172, thereby maximizing their effort expended as indicated on monitor 168. If the individual fatigues and cannot maintain gap 190, force plate 226 will contact and engage plunger 182. Footholds 114 and 116 and motors 12*a* and 12*b* will begin to increase the amount of work expended to raise and lower the calves of the individual and the individual will expend less energy. As the individual fatigues further, plunger 182 descends deeper into force gauge 184 resulting in even less energy expended by the individual and more work done by motors 12*a* and 12*b*. As force plate 226 contacts plunger 182, force measurements are taken and results displayed on monitor 168. Once again, the effort information provided on monitor 168 may be used by the individual user of exercise apparatus 200, prescribing physical therapist, trainer, prescribing physician and others to guide development of the abdomen muscles to speed rehabilitation and improve overall health of the individual.

In yet another embodiment of the present invention illustrated in FIGS. 4A-4J, electric motors 12*a*, 12*b* may be added to a vertical climber 124 to enable motorized guidance exercise apparatus 300. Climber 124 includes a base 126 that engages or rests on a floor or other flat surface and secures motors 12*a*, 12*b* to climber 124. A pair of posts 128*a*, 128*b* extend upward at an angle from base 126 and over base 126. Posts 128*a* and 128*b* are generally parallel to one another and separated a width to enable a human body to pass in between posts 128*a* and 128*b*. Posts 128*a* and 128*b* with base 126 are configured to as a frame 242 for climber 124. Climber 124 further includes a pair of handles 130*a*, 130*b* and pedals 132*a*, 132*b* that are captured to posts 128*a*, 128*b* respectively. Handles 130*a*, 130*b* and pedals 132*a*, 132*b* are enabled to slide freely within slots (not pictured) of posts 128*a*, 128*b* respectively. Handle 130*a* and pedal 132*a* are mechanically connected within post 128*a* by a belt 146*a*, chain and the like to enable handle 130*a* and pedal 132*a* to slide freely about post 128*a* together as in any typical vertical climber. Handle 130*b* and pedal 132*b* are mechanically connected within post 128*b* by a belt 146*b*, chain and the like to enable handle 130*b* and pedal 132*b* to slide freely about post 128*b* together as in any typical vertical climber. An individual may engage handles 130*a*, 130*b* with hands and pedals 132*a*, 132*b* with feet and move their hands and feet along posts 128*a*, 128*b* to active climber 124. The individual may continue with hands engaging handles 130*a*, 130*b* and feet engaging pedals 132*a*, 132*b* in an up and down motion to simulate a climbing motion and exercise the muscles of the arms and legs.

A seat 134 may also be added to vertical climber 124. Seat 134 may include a stanchion 136 that extends upward from base 126 and provides the individual with support while the individual is exercising with vertical climber 124. Much of the load or weight of the individual may be borne or carried by seat 134 to further isolate the muscles of the arms and legs.

In this particular embodiment of the present invention, weight stacks 50*a*, 50*b* including a plurality of weight plates 44*a*, 44*b* may be added to exercise apparatus 300 to provide assistance and resistance for the arm and leg muscles of the individual to raise and lower handles 130*a*, 130*b* and pedals 132*a*, 132*b* of vertical climber 124. The individual may be connected to weight plates 44*a*, 44*b* by cuffs 138*a*, 138*b* secured at the wrists of the individual and cables 140*a*, 140*b* connected between cuffs 138*a*, 138*b* and weight plates 44*a*, 44*b* (see FIG. 4A). Pulleys 142*a*, 142*b* positioned near the top of posts 128*a*, 128*b* guide cables 140*a*, 140*b* from vertical climber 124 to the set of pulleys 144*a*, 144*b* at weight stacks 50*a*, 50*b*. Pulleys 142*a*, 142*b* and 144*a*, 144*b* enables cables 140*a*, 140*b* to glide smoothly as the arms move up and down with handles 130*a*, 130*b* on vertical climber 94. Weights plates 44*a*, 44*b* will provide assistance and resistance to the arm muscles as the arms of the individual are raised and lowered on vertical climber 124. The amount of assistance and resistance may be adjusted by increasing or decreasing the number of weight plates 44*a*, 44*b* in the stack. It is important to note that weight stacks 50*a*, 50*b* may be substituted with a barbell, dumbbells, springs, bands, a weighted vest 152 (see FIG. 4G) and the like and still provide assistance and resistance for the individual using vertical climber 124. Further, the diameter of handles 130*a*, 130*b* may be of a large diameter relative to the size of the hands of the individual to aid the individual in lightly grasping the posts during the exercise motion to enable the individual to concentrate on following the up and down motion of the posts while engaging the weight plates.

Electric motors 12*a*, 12*b* may secured to base 126 of vertical climber 124 at posts 128*a*, 128*b* respectively. Shaft 26*a*, 26*b* of motors 12*a*, 12*b* may be connected to drive guidance assemblies 154*a*, 154*b*. Drive guidance assemblies 154*a*, 154*b* include gears 148*a*, 148*b* that interface with belts 146*a*, 146*b* (see FIG. 4J for motor 12*a*, shaft 26*a*, gear 148*a* and belt 146*a*). Motor 12*a* may be energized to induce a rotary motion in drive guidance assembly 154*a* (in gear 148*a* to drive belt 146*a*) in a first direction to force handle 130*a* and pedal 132*a* upward. At the same instance, Motor 12*b* may be energized to induce a rotary motion in drive guidance assembly 154*b* (gear 148*b* to drive belt 146*b*) in a second, opposite, direction to force handle 130*b* and pedal 132*b* downward. Motors 12*a*, 12*b* may be energized in a reverse direction to induce drive guidance assemblies 154*a*, 154*b* in the opposite direction to force handle 130*a* and pedal 132*a* downward while handle 130*b* and pedal 132*b* and forced upward.

With individual positioned on vertical climber as shown in FIGS. 4A-4D, apparatus 300 may be operated in the following manner. As stated above, electric motor 12*a* may be actuated to rotate drive guidance assembly 154*a* including gear 148*a* and drive belt 146*a* in a first direction to force handle 130*a* and pedal 130*a* upward relative to base 126. Electric motor 12*b* may be actuated to rotate drive guidance assembly 154*b* including gear 148*b* and drive belt 146*b* in a second, opposite direction to force handle 130*b* and pedal 130*b* downward relative to base 126. As handle 130*a* and pedal 132*a* are driven upward, the arm and leg of the individual follow the upward motion of handle 130*a* and pedal 132*a* thereby forcing cuffs 138*a* at the wrist upward and driving cable 140*a* to lower weight plates 44*a* of weight stack 50*a*. Conversely, as handle 130*b* and pedal 132*b* are driven downward, the arm and leg of the individual follow the downward motion of handle 130*b* and pedal 132*b* thereby forcing cuffs 138*b* at the wrist downward and pulling on cable 140*b* to raise weight plates 44*b* of weight stack 50*b*. The hands of the individual are lightly gripping handles 130*a*, 130*b* and using tactile feedback from the handles 130*a*, 130*b* at the hands to indicate to the individual when to follow the paths of vertical climber 124 to raise and lower their hands and pull and release cables 140*a*, 140*b* attached at their wrists. Cables 140*a*, 140*b* remain in tension throughout the exercise and apply a load to both arms whether pulling or releasing cables 140*a*, 140*b*. When the handle 130 is moved downward, the muscles of the arm are contracting and shortening to raise weight plates 44 relative to weight stack 50. When the handle 130 is moved upward, the muscles of the arm are expanding and lengthening to lower weight plates 44 relative to weight stack 50. Motorized guidance exercise apparatus 300 enables the arm muscles to be exercised in both the downward and upward motion of vertical climber 124 thereby increasing the work done by the muscles of the arms to speed the increase of muscle mass to improve health and speed rehabilitation and recovery. Further, the amount of weight at weight stack 50*a* and weight stack 50*b* may be different to enable the muscles of one arm to exercise under a different resistance from the muscles of the other arm. This again will allow an individual with an injury or other damage to the muscles of one arm to rehabilitate at a lower weight than the muscles of the other arm thereby speeding recovery of the injured arm muscles. The amount of time motors 12*a*, 12*b* are actuated to rotate gears 148*a* in a first direction and gears 148*b* in a second direction may be adjusted to increase the travel of handles 130*a*, 130*b* and pedals 132*a*, 132*b* upward and downward, respectively. The longer motors 12*a* is actuated to rotate gears 148*a* in a first direction and gears 148*b* in a second direction, the further handles 130*a*, 130*b* and pedals 132*a*, 132*b* will be driven apart. Increasing the distance handles 130*a*, 130*b* and pedals 132*a*, 132*b* travel apart will also help to improve the flexibility of the individual. Further, apparatus 300 will enable individuals to exercise arm and leg muscles through isometric exercises when motors 12*a*, 12*b* are stopped for a period of time to hold handles 130*a*, 130*b* and pedals 132*a*, 132*b* at one or more predetermined locations.

Figure 4A:
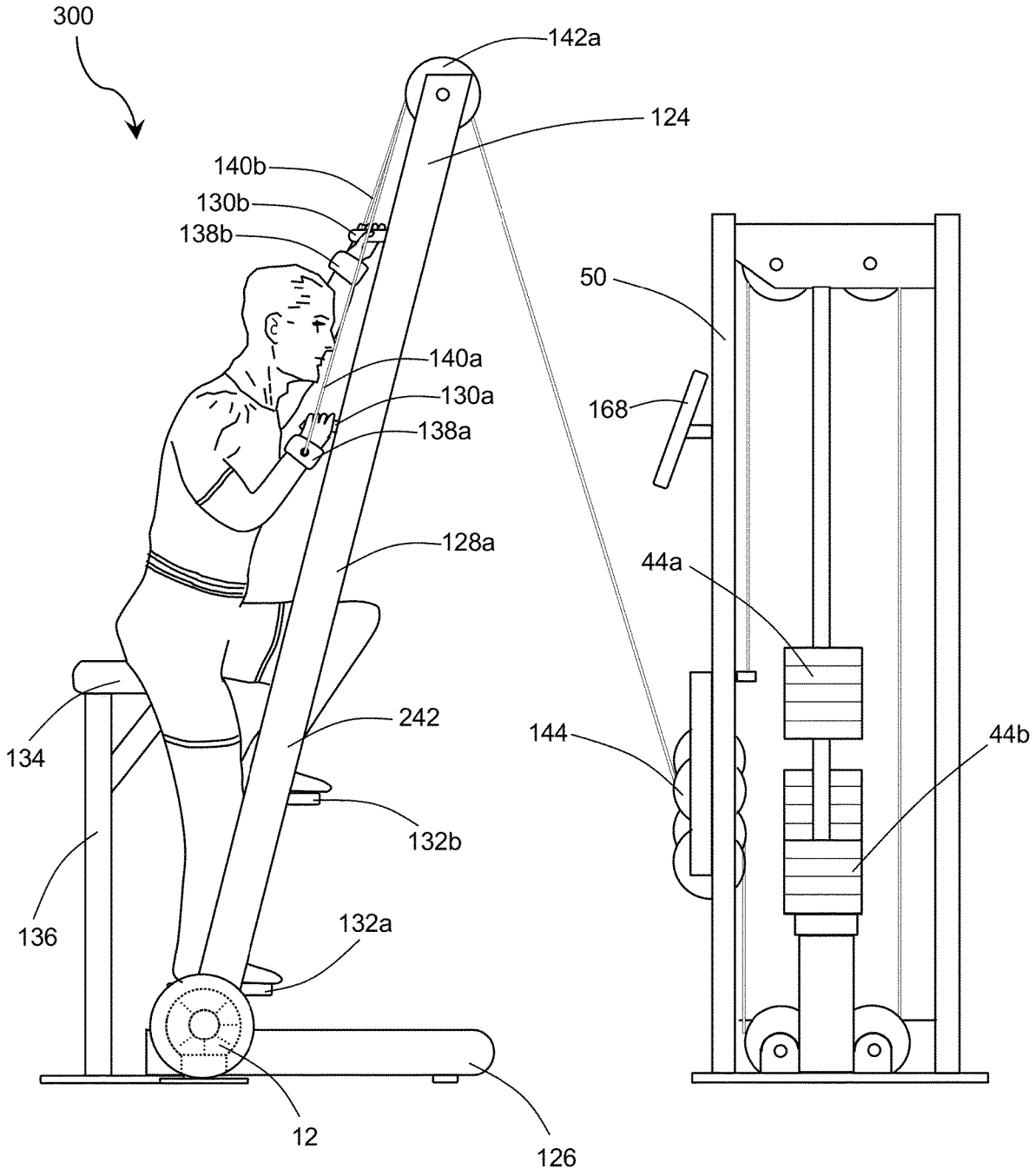
FIG. 4A is a side view of a motorized guidance exercise apparatus according to still another embodiment of the present invention.
Figure 4B:
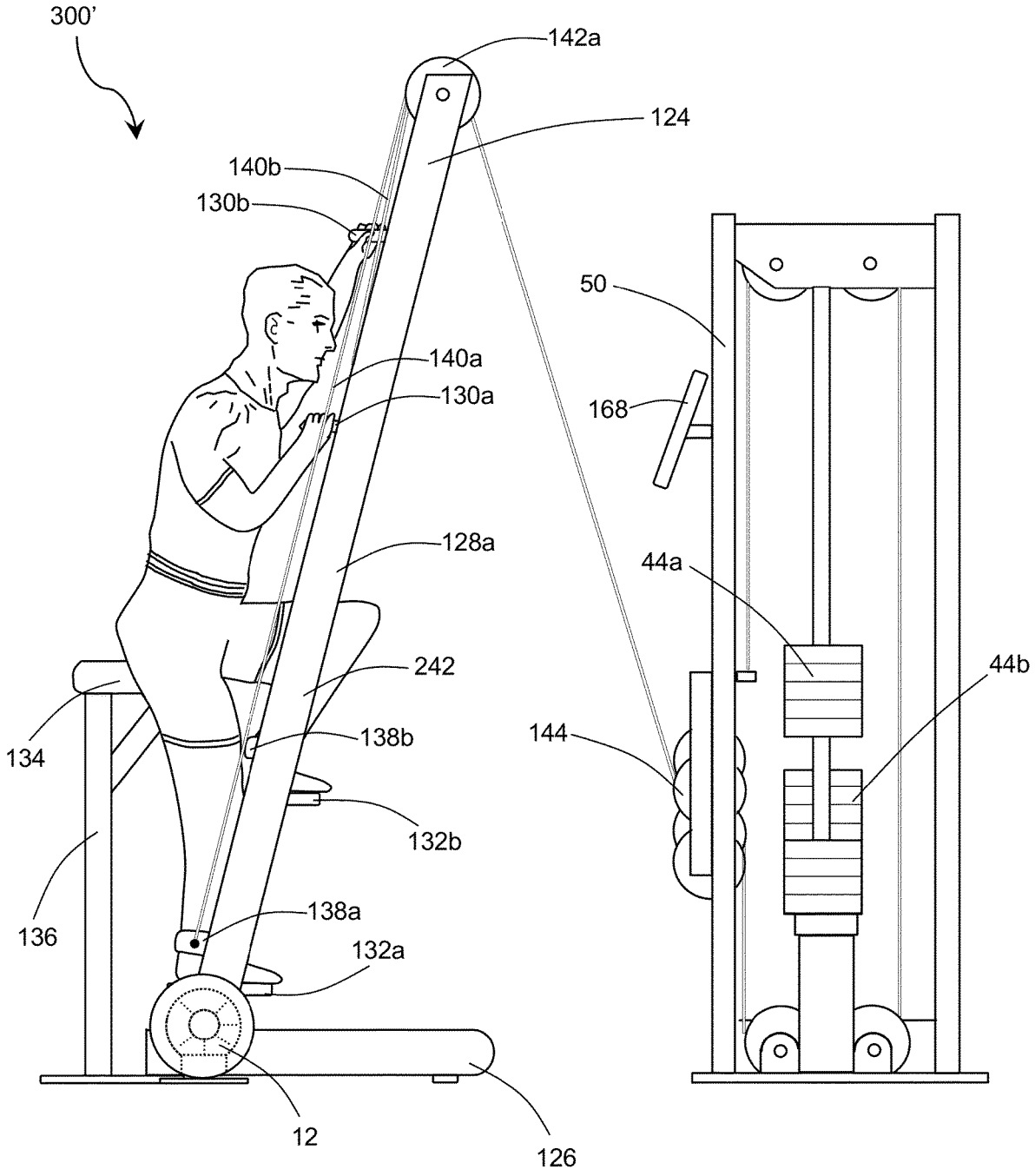
FIG. 4B is a side view of a motorized guidance exercise apparatus according to yet another embodiment of the present invention.

In yet another embodiment of the present inventions illustrated in FIG. 4B, cuffs 138*a*, 138*b* may be secured to the ankles of the individuals and a motorized guidance exercise apparatus 300' may be operated in the following manner. As stated above, electric motor 12*a* may be actuated to rotate drive guidance assembly 154*a* including gear 148*a* and drive belt 146*a* in a first direction to force handle 130*a* and pedal 130*a* upward relative to base 126. Electric motor 12*b* may be actuated to rotate drive guidance assembly 154*b* including gear 148*b* direction and drive belt 146*b* in a second, opposite direction to force handle 130*b* and pedal 132*b* downward relative to base 126. As handle 130*a* and pedal 132*a* are driven upward, the arm and leg of the individual are also following handle 130*a* and pedal 132*a* upward thereby forcing cuffs 138*a* at the ankle upward and driving cable 140*a* to lower weight plates 44*a* of weight stack 50*a*. Conversely, as handle 130*b* and pedal 132*b* are driven downward, the arm and leg of the individual are also following handle 130*b* and pedal 132*b* downward thereby forcing cuffs 138*b* at the ankle downward and pulling on cable 140*b* to raise weight plates 44*b* of weight stack 50*b*. The feet of the individual are lightly resting on pedals 132*a*, 132*b* and using tactile feedback from the pedals 132*a*, 132*b* at the ankles to indicate to the individual when to follow the paths of vertical climber 124 to raise and lower their ankles and pull and release cables 140*a*, 140*b* attached at their ankles. Maintaining a light contact between the heel and pedals 132*a*, 132*b* ensures optimal performance of the affected muscles during the exercise. Cables 140*a*, 140*b* remain in tension throughout the exercise and apply a load to both legs whether pulling or releasing cables 140*a*, 140*b*. When the pedal 132 is moved downward, the muscles of the legs are contracting and shortening to raise weight plates 44 relative to weight stack 50. When the pedal 132 is moved upward, the muscles of the legs are expanding and lengthening to lower weight plates 44 relative to weight stack 50. Motorized guidance exercise apparatus 300' enables the leg muscles to be exercised in both the downward and upward motion of vertical climber 124 thereby increasing the work done by the muscles of the legs to speed the increase of muscle mass to improve health and speed rehabilitation and recovery. Further, the amount of weight at weight stack 50*a* and weight stack 50*b* may be different to enable the muscles of one leg to exercise under a different resistance from the muscles of the other leg. This again will allow an individual with an injury or other damage to the muscles of one leg to rehabilitate at a lower weight than the muscles of the other leg thereby speeding recovery of the injured leg muscles.

Figure 4C:
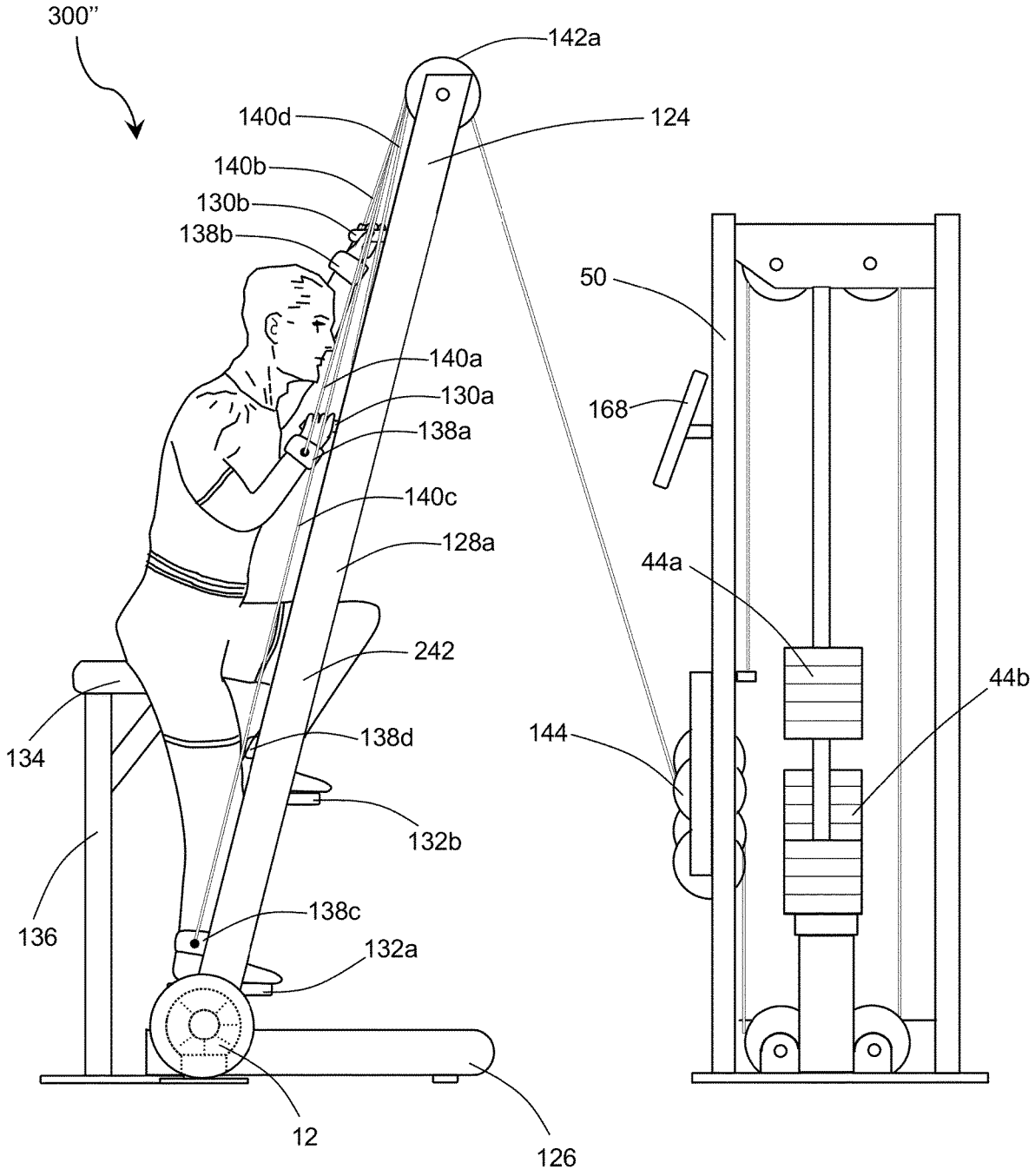
FIG. 4C is a side view of a motorized guidance exercise apparatus according to still another embodiment of the present invention.
Figure 4D:
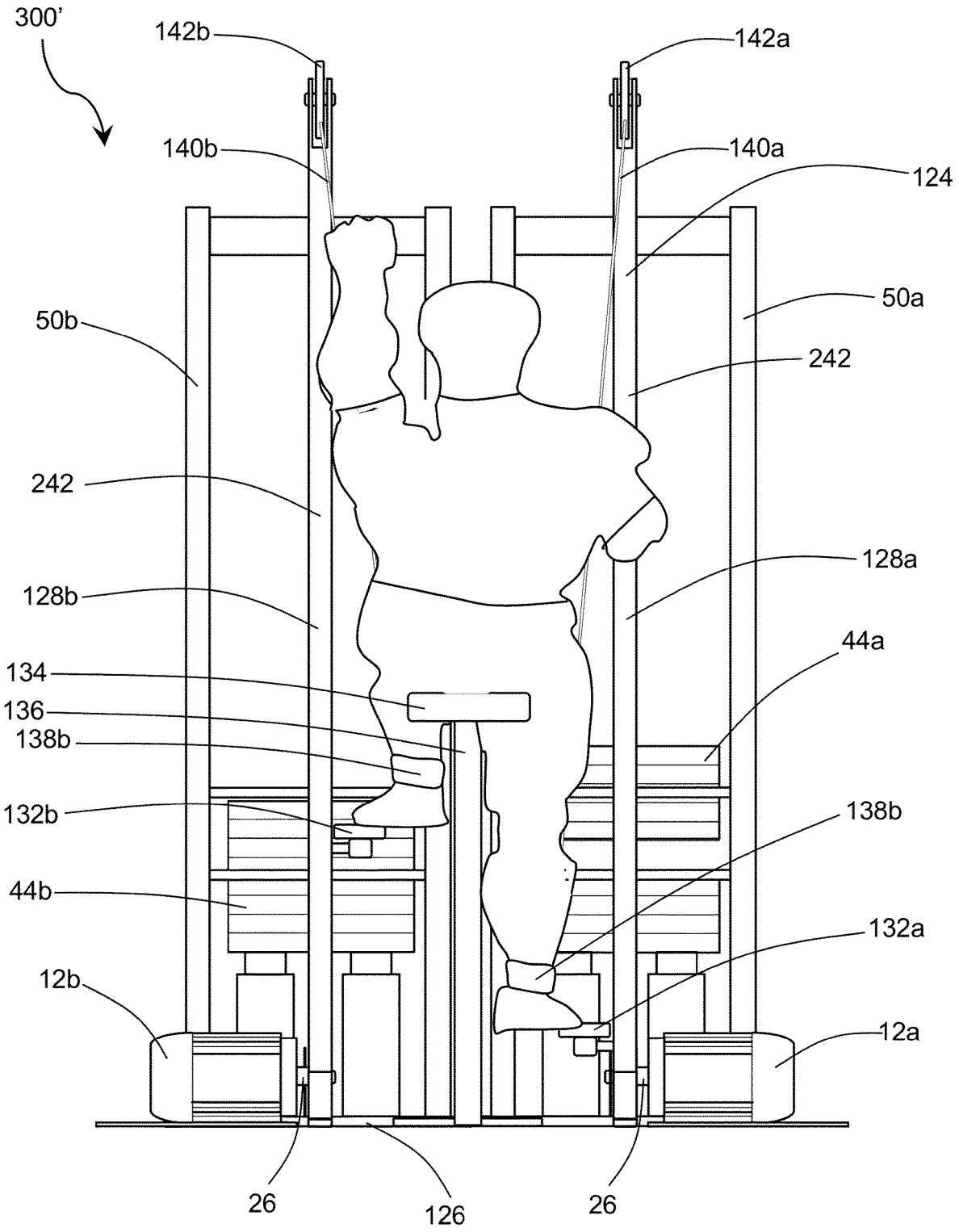
FIG. 4D is a front view of the motorized guidance exercise apparatus depicted in FIG. 4B.
Figure 4E:
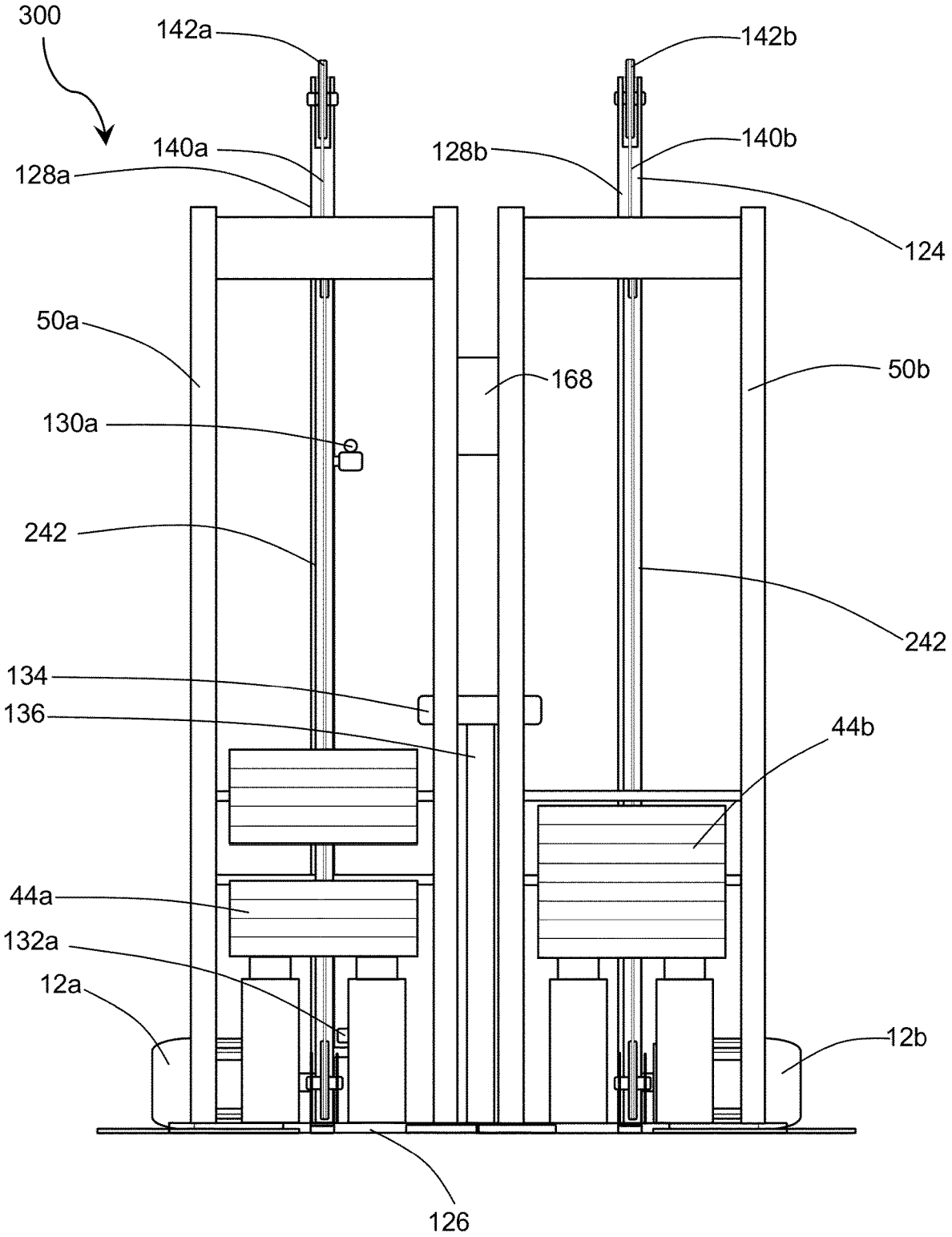
FIG. 4E is a rear view of the motorized guidance exercise apparatus depicted in FIG. 4B.

In still another embodiment of the present invention depicted in FIG. 4C, cuffs 138*a*, 138*b* may be secured to the wrists of the individuals and cuffs 138*c*, 138*d* may be secured to the ankles of the individuals and a motorized guidance exercise apparatus 300" may be operated in the same manner as described above for exercise apparatus 300 and 300'. Cable 140*a* may be secured between cuff 138*a* at the wrist and weight plates 44*a* of weight stack 50*a*. Cable 140*b* may be secured between cuff 138*b* at the wrist and weight plates 44*b* of weight stack 50*b*. Cable 140*c* may be secured between cuff 138*c* at the ankle and weight plates 44*a* of weight stack 50*a*. Cable 140*d* may be secured between cuff 138*d* at the ankle and weight plates 44*b* of weight stack 50*b*. Alternatively, cuffs 138*c*, 138*d* at the ankles may be secured to separate weight plates from weight plates 44*a*, 44*b* (not shown). With motorized guidance exercise apparatus 300" configured in this manner, the individual may work the muscles of the legs and arms at the same time and with a different amount of weight set for each limb to provide for the optimal development and rehabilitation of the specific muscles of the legs and arms.

Figure 4F:
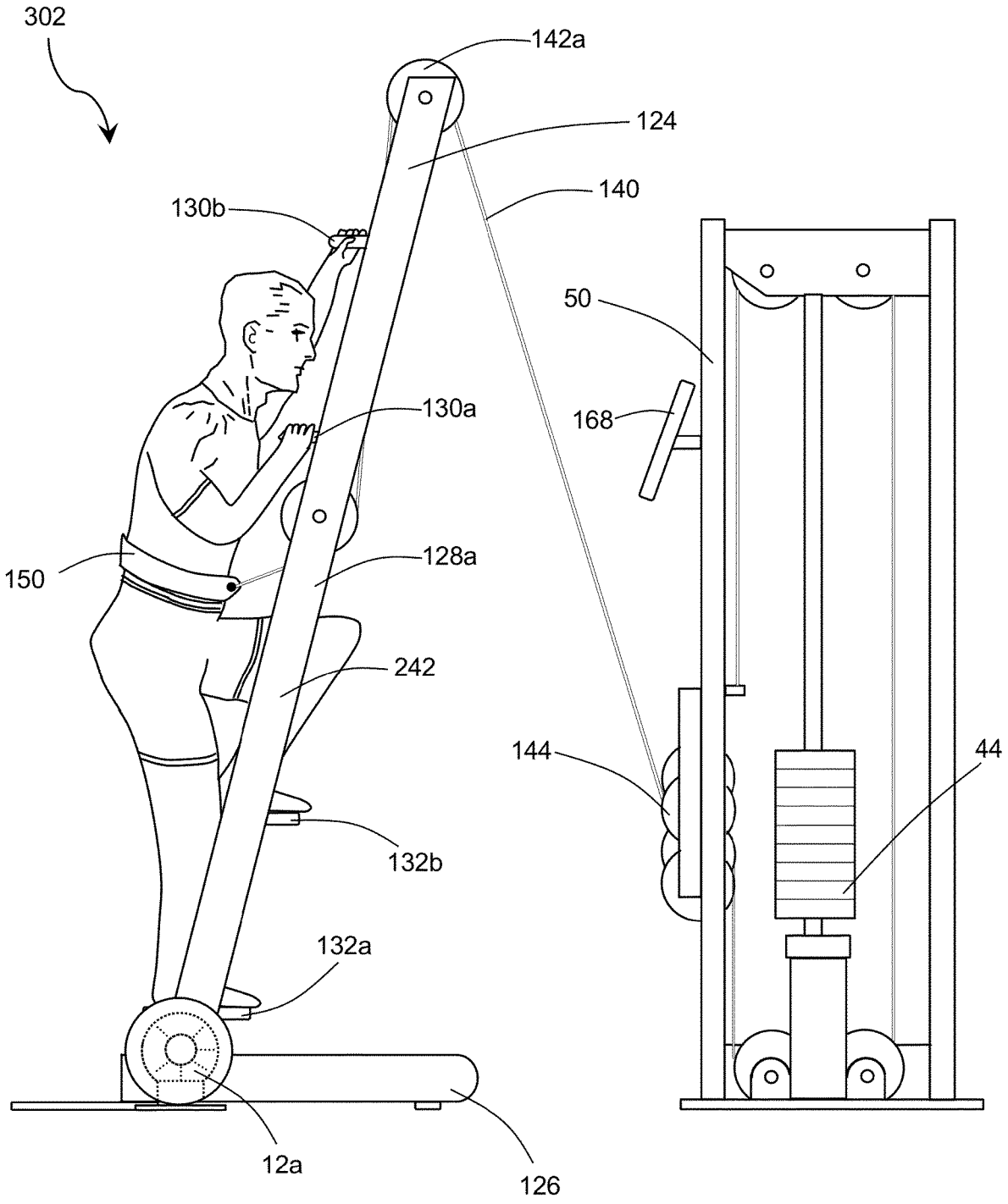
FIG. 4F is a side view of a motorized guidance exercise apparatus according to another embodiment of the present invention.

In yet another embodiment of the present inventions illustrated in FIG. 4F, a harness 150 may be secured to the torso of the individual, and, in conjunction with weight stack 50 and weight plates 44, provide the resistance means of a motorized guidance exercise apparatus 302. In this particular embodiment of the present invention, vertical climber 124 will operate as described above. Handles 130*a*, 130*b* and pedals 132*a*, 132*b* will support the hands and feet of the individual and provide the tactile feedback to the individual indicating when to move their hands and feet and in which direction along vertical climber 124. Harness 150 with weight plates 44 will provide additional weight resistance to the individual that will help to train or exercise and exhaust the muscles of the arms and legs as described above. It is this training of the arm and leg muscles that will speed recovery of any muscle rehabilitation and improve any training an individual may undertake to improve their overall health of compete in a competition.

Figure 4G:
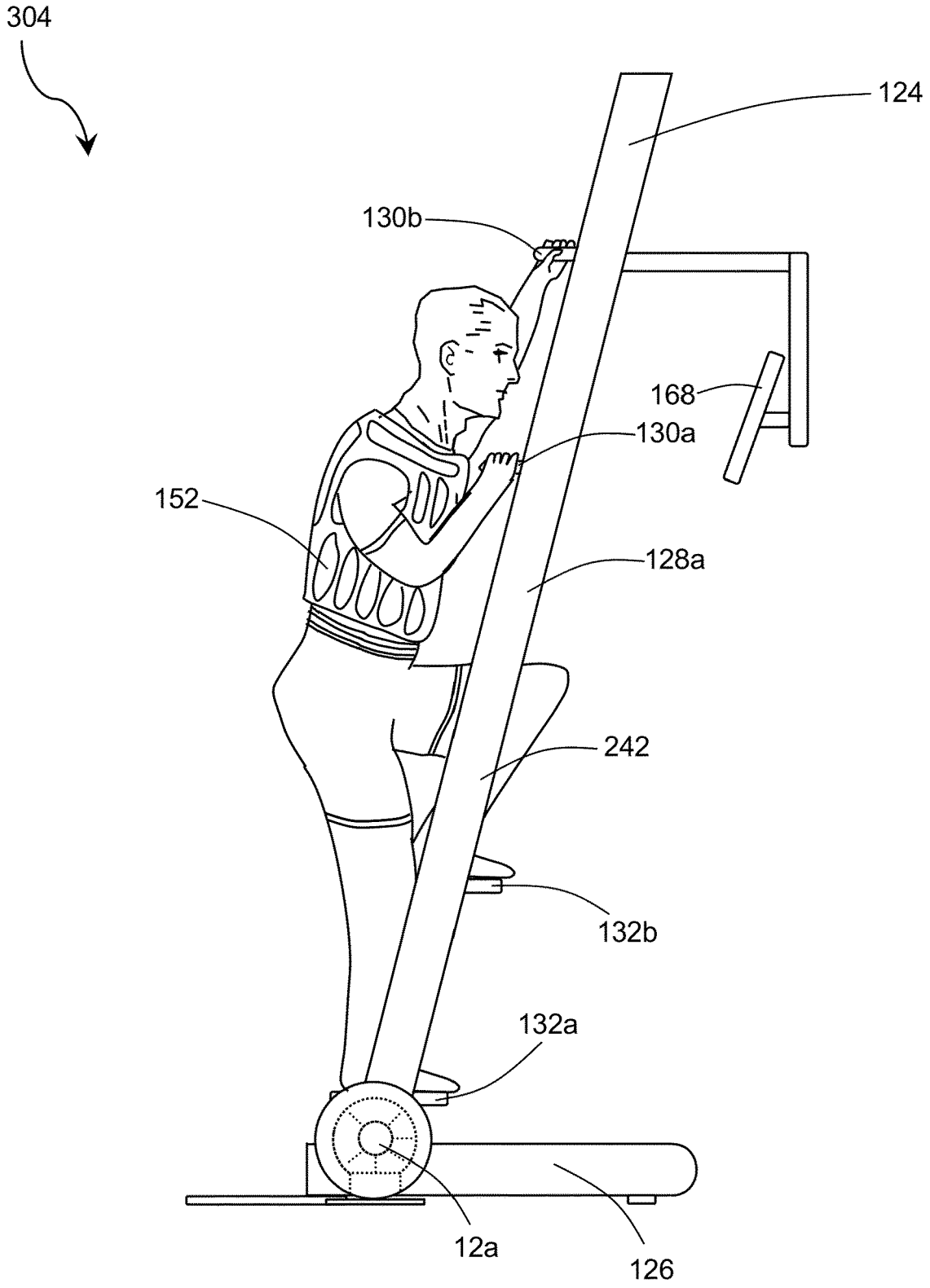
FIG. 4G is a side view of a motorized guidance exercise apparatus according to still another embodiment of the present invention.
Figure 4H:
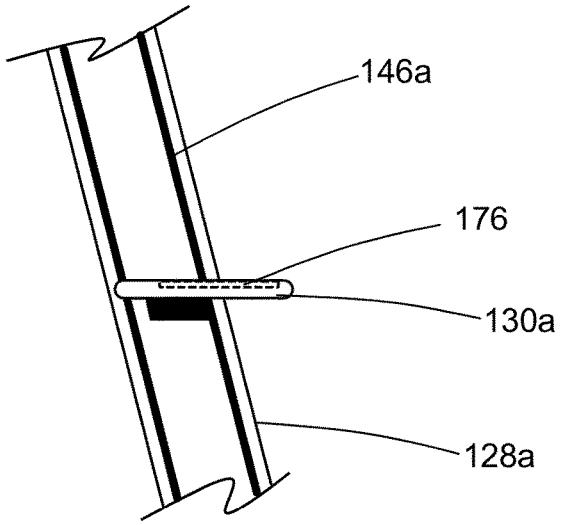
FIGS. 4H-4J are side views of a gear and a belt assembly of the motorized guidance exercise apparatus depicted in FIGS. 4A-4G.
Figure 4I:
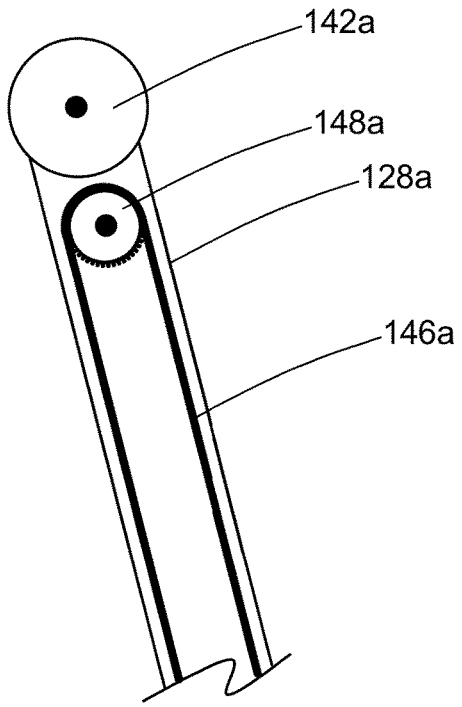
Figure 4J:
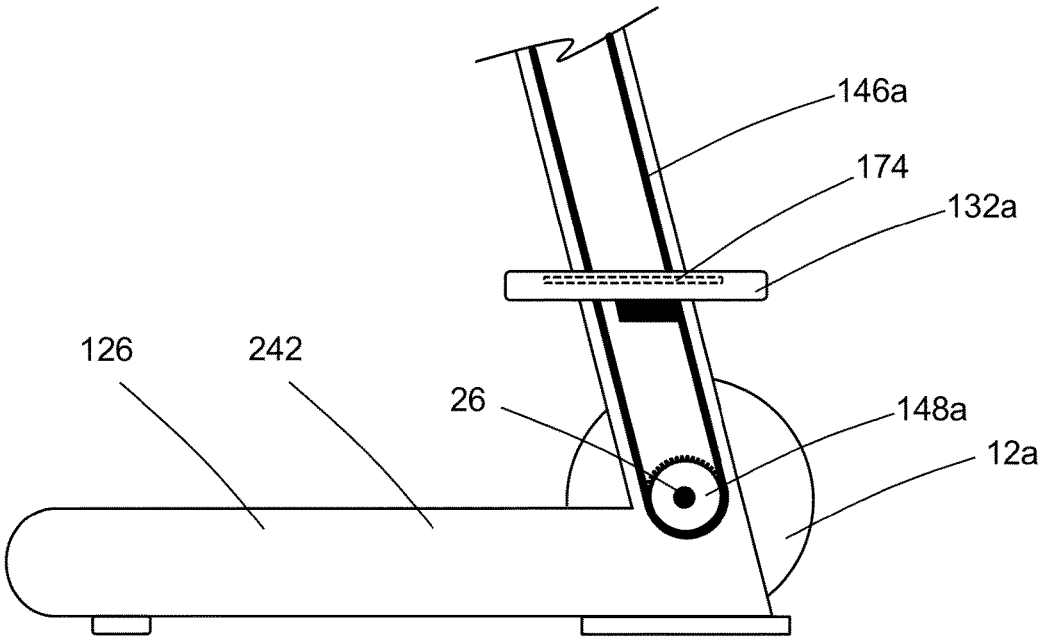
Figure 4K:
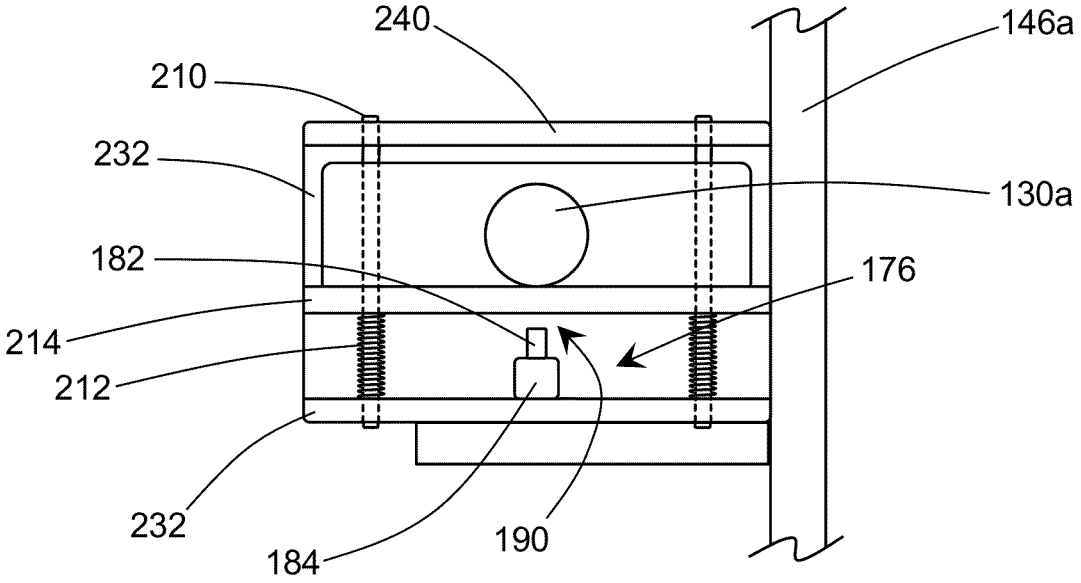
FIG. 4K is a front view of a force sensor and a handle of the motorized guidance exercise apparatus depicted in FIGS. 4A-4G.
Figure 4L:
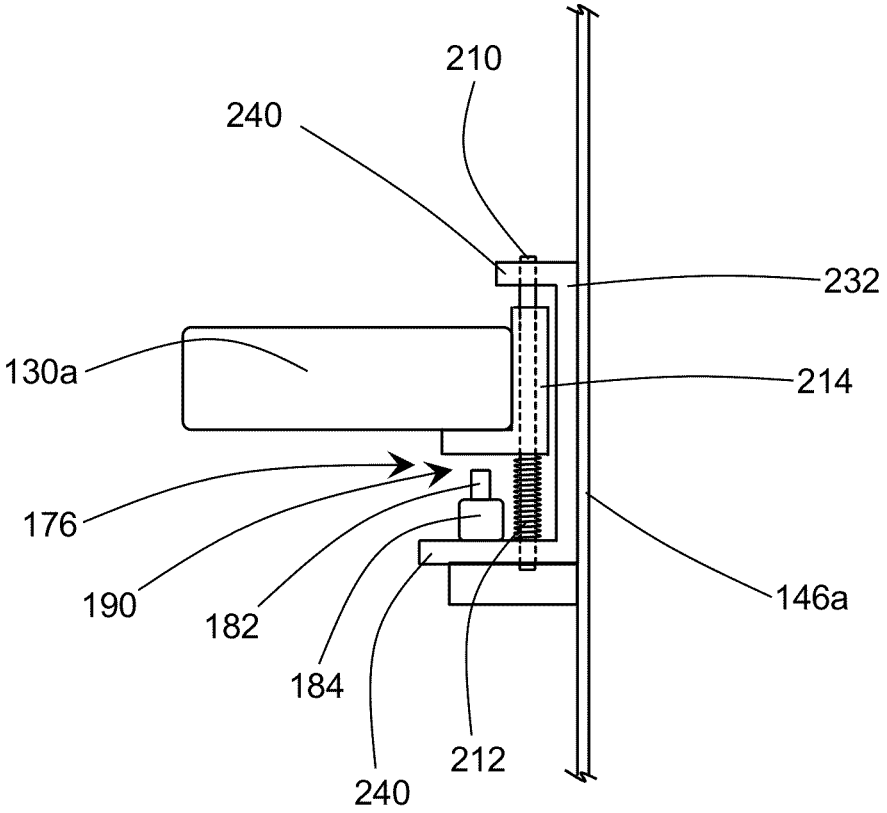
FIG. 4L is a side view of the force sensor and the handle of the motorized guidance exercise apparatus depicted in FIGS. 4A-4G.
Figure 4M:
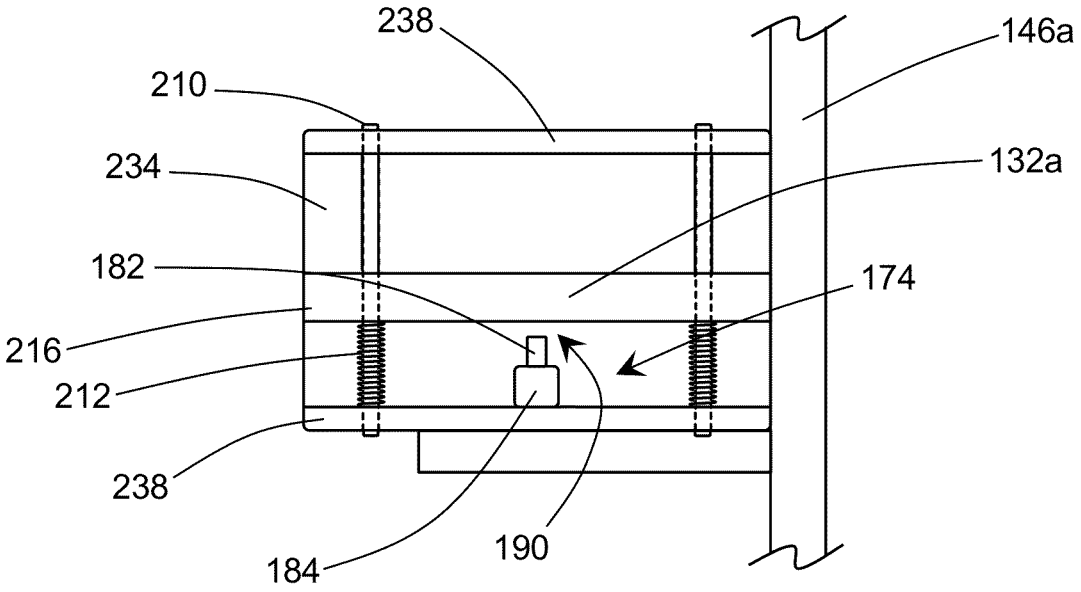
FIG. 4M is a front view of a force sensor and a pedal of the motorized guidance exercise apparatus depicted in FIGS. 4A-4G.
Figure 4N:
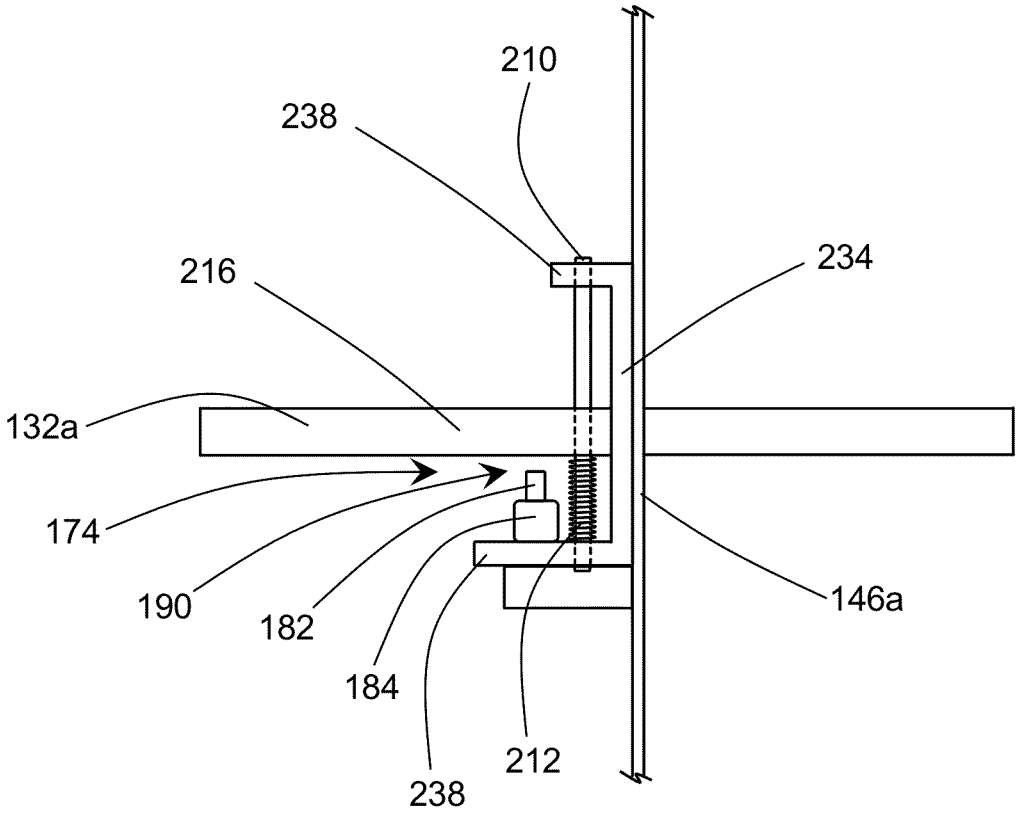
FIG. 4N is a side view of the force sensor and the pedal of the motorized guidance exercise apparatus depicted in FIGS. 4A-4G.
Figure 5:
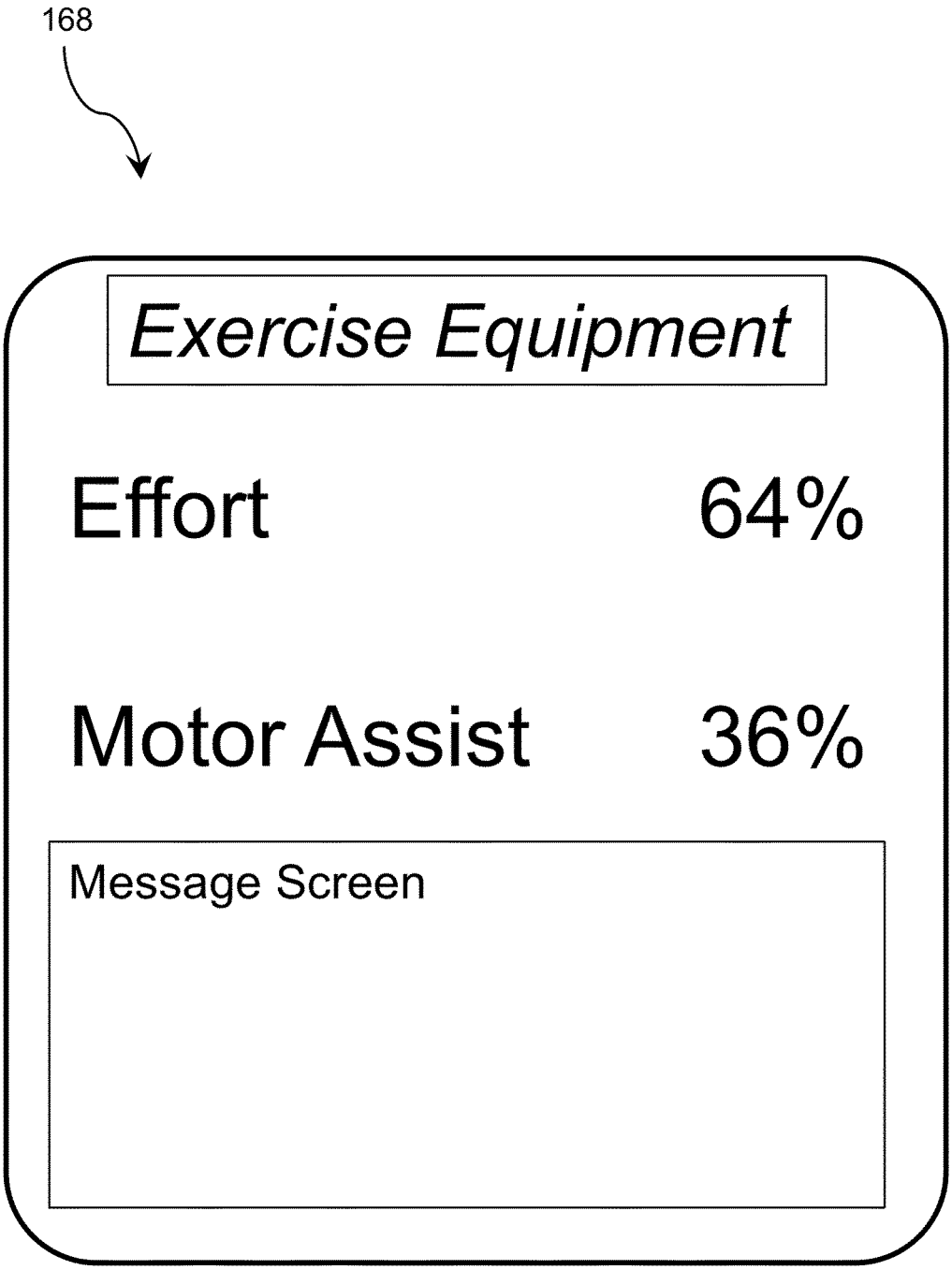

In still another embodiment of the present inventions illustrated in FIG. 4G, a weighted vest 152 may be secured to the individual to provide the resistance means of a motorized guidance exercise apparatus 304. In this particular embodiment of the present invention, vertical climber 124 will operate as described above. Handles 130*a*, 130*b* and pedals 132*a*, 132*b* will support the hands and feet of the individual and provide the tactile feedback to the individual indicating when to move their hands and feet and in which direction along vertical climber 124. Weighted vest 152 will provide additional weight resistance to the individual that will help to train or exercise and exhaust the muscles of the arms and legs as described above. It is this training of the arm and leg muscles that will speed recovery of any muscle rehabilitation and improve any training an individual may undertake to improve their overall health of compete in a competition.

Now referring to FIGS. 4K-4N, a force sensor 174 may be included in each of pedals 132*a*, 132*b* (see FIGS. 4M and 4N) and a force sensor 176 may be included in each of handles 130*a*, 130*b* (see FIGS. 4K and 4L) to indicate to the individual, through monitor 168, the amount of force the individual is applying to pedals 132*a*, 132*b* and handles 130*a*, 130*b* during the exercise motion. As stated above, the individual may need to exert more effort in terms of energy by the human body to maintain a light contact with pedals 132*a*, 132*b* and handles 130*a*, 130*b* as pedals 132*a*, 132*b* and handles 130*a*, 130*b* are driven up and down on climber 124 by motors 12*a* and 12*b* and drive guidance assemblies 154*a* and 154*b*. In this instance, the force against sensors 174, 176 may be low and the human "Effort" reading on monitor 168 (see FIG. 5) may be high, for example close to 100% and the "Motor Assist" reading may be low, for example close to 0%. This would indicate to the individual that they are using their muscles at near maximum effort during the exercise to follow the motion of pedals 132*a*, 132*b* and handles 130*a*, 130*b*, rather than relying on support from pedals 132*a*, 132*b*, handles 130*a*, 130*b*, and motors 12*a*, 12*b*, resulting in near optimal development of the subject muscles in the arms and legs. Conversely, the individual may rely on pedals 132*a*, 132*b*, handles 130*a*, 130*b* and motors 12*a*, 12*b*, for assistance to move pedals 132*a*, 132*b* and handles 130*a*, 130*b* up and down on climber 124. In this instance, the force against sensors 174, 176 may be high and the human "Effort" reading on monitor 168 may be low, for example close to 50% and the "Motor Assist" reading may be high, for example close to 50%. This would indicate to the individual that they are using their muscles at near minimal effort during the exercise as their legs and arms moved by pedals 132*a*, 132*b*, handles 130*a*, 130*b* and motors 12*a*, 12*b* rather than having their feet and hands apply only light force against pedals 132*a*, 132*b* and handles 130*a*, 130*b* and following the motion of pedals 132*a*, 132*b* and handles 130*a*, 130*b* such that the leg and arm muscles are doing much of the work rather than motors 12*a* and 12*b*. The effort information provided on monitor 168 may be used by the individual user of exercise apparatus 300. 300', 300", 302 or 304, prescribing physical therapist, trainer, prescribing physician and others to guide development of the leg and hip muscles to speed rehabilitation and improve overall health of the individual.

Force sensor 174 (see FIGS. 4M and 4N) may include a force plate 216 and a support plate 234. A pair of guide rods 210 are inserted into a pair of compression springs 212 and both are connected to legs 238 of support plate 234 and capture force plate 216 to pedals 132*a* and 132*b* thereby allowing force plate 216 to slide freely on pedals 132*a* and 132*b* and between legs 238 of support plate 234. Force gauge plunger 182 and force gauge 184 are positioned and secured to support plate 234. The tension in compression springs 212 maintain a gap 190 between force plate 216 and force gauge plunger 182. Gap 190 enables the individual to experience the tactile feedback from pedals 132*a* and 132*b*. As detailed above, the individual will expend effort in the form of leg muscle fatigue to maintain gap 190 and not activate plunger 182 and force gauge 184 as pedals 132*a* and 132*b* move up and down about apparatus 300, 300', 300", 302 or 304, thereby maximizing their effort expended as indicated on monitor 168. If the individual fatigues and cannot maintain gap 190, force plate 216 will contact and engage plunger 182 and force plunger 182 into force gauge 184. Pedals 132*a* and 132*b* of climber 124 and motors 12*a* and 12*b* will begin to increase the amount of work expended to move the legs of the individual up and down climber 124 and the individual will expend less energy. As the individual fatigues further, plunger 182 descends deeper into force gauge 184 resulting in even less energy expended by the individual and more work done by motors 12*a* and 12*b*. As force plate 216 contacts plunger 182, force measurements are taken and results displayed on monitor 168.

Force sensor 176 (see FIGS. 4K and 4L) may include a force plate 214 and a support plate 232. Guide rods 210 are inserted into compression springs 212 and both are connected to legs 240 of support plate 232 and capture force plate 214 to handles 130*a* and 130*b* thereby allowing force plate 214 to slide freely on handles 130*a* and 130*b* and between legs 240 of support plate 232. Force gauge plunger 182 and force gauge 184 are positioned and secured to support plate 232. The tension in compression springs 212 maintain a gap 190 between force plate 214 and force gauge plunger 182. Gap 190 enables the individual to experience the tactile feedback from handles 130*a* and 130*b*. As detailed above, the individual will expend effort in the form of arm muscle fatigue to maintain gap 190 and not activate plunger 182 and force gauge 184 as handles 130*a* and 130*b* move up and down about apparatus 300, 300', 300", 302 or 304, thereby maximizing their effort expended as indicated on monitor 168. If the individual fatigues and cannot maintain gap 190, force plate 214 will contact and engage plunger 182 and force plunger 182 into force gauge 184. Handles 130*a* and 130*b* of climber 124 and motors 12*a* and 12*b* will begin to increase the amount of work expended to move the arms of the individual up and down climber 124 and the individual will expend less energy. As the individual fatigues further, plunger 182 descends deeper into force gauge 184 resulting in even less energy expended by the individual and more work done by motors 12*a* and 12*b*. As force plate 214 contacts plunger 182, force measurements are taken and results displayed on monitor 168. Once again, the effort information provided on monitor 168 may be used by the individual user of exercise apparatus 300, 300', 300", 302 or 304, prescribing physical therapist, trainer, prescribing physician and others to guide development of the abdomen muscles to speed rehabilitation and improve overall health of the individual.

The present invention has been particularly shown and described with reference to the foregoing embodiments, which are merely illustrative of the best modes presently known for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiments are illustrative, and no single feature or element is essential to all possible combinations that may be claimed in this or a later application.

What is claimed is:

1. An isometric, dynamic isotonic concentric and dynamic isotonic eccentric motorized guidance exercise apparatus for human muscle development comprising:

at least one electric motor, said at least one electric motor including an output shaft;

a drive guidance assembly, said drive guidance assembly secured to said exercise apparatus and connected to said at least one electric motor, said drive guidance assembly includes a bar, said bar secured between said at least one electric motor and a handle of a weight bench;

at least one tactile feedback interface member, said at least one tactile feedback interface member is a headboard of said weight bench and said headboard is secured to said drive guidance assembly at said handle;

an assistance and resistance force device, said assistance and resistance force device configured to be secured to a limb or a torso of the human body, the limb or the torso positioned proximate said headboard;

at least one force sensor, said at least one force sensor calibrated to determine the effort expended by the human muscle to move said assistance and resistance force device; and wherein energizing said at least one electric motor actuates said drive guidance assembly, said at least one electric motor induces a linear motion in said bar and said handle to raise and lower said headboard relative to said weight bench, wherein said headboard is configured to be engaged by the limb or the torso and said assistance and resistance force device is configured to be actuated by the limb or the torso.

2. The exercise apparatus as recited in claim 1, wherein said headboard includes said at least one force sensor.

3. The exercise apparatus as recited in claim 1, wherein said at least one force sensor includes:

at least one force plate;

a support plate;

at least one force gauge, said at least one force gauge including at least one force gauge plunger;

at least one guide rod; and at least one compression spring.

4. The exercise apparatus as recited in claim 1, wherein said assistance and resistance force device is at least one weight plate of a weight stack, said at least one weight plate configured to be connected by a cable to the limb or the torso of the human body.

* * * * *